US011149372B2

(12) United States Patent
Shinohara et al.

(10) Patent No.: US 11,149,372 B2
(45) Date of Patent: Oct. 19, 2021

(54) WASHING MACHINE

(71) Applicant: Samsung Electronics Co., Ltd., Suwon-si (KR)

(72) Inventors: Nobuhiko Shinohara, Yokohama (JP); Atsushi Ohyagi, Yokohama (JP); Hiroki Takita, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 56 days.

(21) Appl. No.: 16/485,151

(22) PCT Filed: Jan. 31, 2018

(86) PCT No.: PCT/KR2018/001313
§ 371 (c)(1),
(2) Date: Aug. 9, 2019

(87) PCT Pub. No.: WO2018/147587
PCT Pub. Date: Aug. 16, 2018

(65) Prior Publication Data

US 2020/0040509 A1 Feb. 6, 2020

(30) Foreign Application Priority Data

Feb. 10, 2017 (JP) ..... JP2017-023132
Feb. 16, 2017 (JP) ..... JP2017-026937
Apr. 26, 2017 (JP) ..... JP2017-086959

(51) Int. Cl.
*D06F 33/48* (2020.01)
*D06F 103/06* (2020.01)
(Continued)

(52) U.S. Cl.
CPC ..... *D06F 33/48* (2020.02); *D06F 33/40* (2020.02); *D06F 34/16* (2020.02); *D06F 34/32* (2020.02);
(Continued)

(58) Field of Classification Search
CPC ..... D06F 34/16; D06F 34/18
See application file for complete search history.

(56) References Cited

U.S. PATENT DOCUMENTS 5,720,066 A * 2/1998 Kim ..... D06F 34/16 8/159
2004/0148709 A1* 8/2004 Kim ..... D06F 34/18 8/158
(Continued)

FOREIGN PATENT DOCUMENTS

EP 2597187 A1 5/2013
JP H10-57661 A 3/1998
(Continued)

OTHER PUBLICATIONS

WO2013011606A1 Machine Translation (Year: 2013).*
(Continued)

*Primary Examiner* — Spencer E. Bell

(57) ABSTRACT

The disclosure provides a washing machine capable of preventing abnormal vibration caused by waterproof clothing during the spin-dry. The washing machine according to the disclosure includes a spin tub receiving laundry; a vibration sensor attached to a water tub that supports the spin tub inside the water tub and capable of detecting vibrations in a plurality of directions; and a processor configured to control rotation of the spin tub and determine a vibration type based on a detection value of the vibration sensor to determine whether there is waterproof clothing in the laundry.

10 Claims, 35 Drawing Sheets

(51) Int. Cl.

| | |
|---|---|
| ***D06F 103/24*** | (2020.01) |
| ***D06F 103/26*** | (2020.01) |
| ***D06F 105/00*** | (2020.01) |
| ***D06F 105/48*** | (2020.01) |
| ***D06F 105/58*** | (2020.01) |
| ***D06F 105/60*** | (2020.01) |
| ***D06F 34/16*** | (2020.01) |
| ***D06F 33/40*** | (2020.01) |
| *D06F 103/18* | (2020.01) |
| *D06F 34/32* | (2020.01) |

(52) U.S. Cl.

CPC ..... *D06F 2103/06* (2020.02); *D06F 2103/18* (2020.02); *D06F 2103/24* (2020.02); *D06F 2103/26* (2020.02); *D06F 2105/00* (2020.02); *D06F 2105/48* (2020.02); *D06F 2105/58* (2020.02); *D06F 2105/60* (2020.02)

(56) References Cited

U.S. PATENT DOCUMENTS

| | | | | |
|---|---|---|---|---|
| 2007/0039104 | A1 | 2/2007 | Lee et al. | |
| 2008/0178398 | A1* | 7/2008 | Darby | D06F 37/145 8/159 |
| 2014/0082958 | A1 | 3/2014 | Chung et al. | |
| 2014/0082959 | A1 | 3/2014 | Oh et al. | |
| 2015/0128357 | A1 | 5/2015 | Koo | |
| 2020/0308749 | A1 | 10/2020 | Ohyagi et al. | |

FOREIGN PATENT DOCUMENTS

| | | | | |
|---|---|---|---|---|
| JP | 2003334398 | A | 11/2003 | |
| JP | 2007319184 | A | 12/2007 | |
| JP | 2012170686 | A | 9/2012 | |
| JP | 2014064918 | A | 4/2014 | |
| JP | 2014064919 | A | 4/2014 | |
| JP | 2015-112316 | A | 6/2015 | |
| JP | 2015165938 | A | 9/2015 | |
| JP | 2015165941 | A | 9/2015 | |
| JP | 2017-176807 | A | 10/2017 | |
| KR | 10-0690687 | B1 | 3/2007 | |
| KR | 10-2015-0054128 | A | 5/2015 | |
| KR | 10-2016-0146057 | A | 12/2016 | |
| WO | WO-2013011606 | A1 * | 1/2013 | D06F 37/304 |

OTHER PUBLICATIONS

International Search Report and Written Opinion regarding International Application No. PCT/KR2018/001313, dated Jun. 4, 2018, 16 pages.

Office Action dated Jun. 8, 2021 in connection with Japanese Patent Application No. 2017-086959, 8 pages.

* cited by examiner

WASHING MACHINE

CROSS-REFERENCE TO RELATED APPLICATIONS

This application is a 371 National Stage of International Application No. PCT/KR2018/001313 filed on Jan. 31, 2018, which claims priority to Japanese Patent Application No. 2017-023132 filed on Feb. 10, 2017, Japanese Patent Application No. 2017-026937 filed on Feb. 16, 2017, and Japanese Patent Application No. 2017-086959 filed on Apr. 26, 2017, the disclosures of which are herein incorporated by reference in their entirety.

BACKGROUND

1. Field

The disclosure relates to a technology to prevent abnormal vibration that might occur in the spin-dry process of a washing machine when a waterproof sheet or something is mistakenly mixed into the laundry.

2. Description of Related Art

Most of recent washing machines are generally supposed to automatically perform a series of processes: washing, rinsing, spin-dry, and even drying (in so-called fully automatic washing machines). In these washing machines, clothes through which no or little water passes, such as water-proof or water-repellent clothes, impervious items (e.g., rain coats or nylon bed covers), etc., (herein collectively called waterproof clothing) typically has difficulty being spin-dried, causing abnormal vibration during the spin-dry cycle, so the waterproof clothing is handled with care not to be spin-dried.

However, the waterproof clothing mixed into the laundry is sometimes mistakenly subject to the spin-dry process. Hence, even for such an occasion, a technology to predict and prevent abnormal vibration is taken into account, and various associated methods have been proposed up to this day.

For example, in patent document 1, a method for sensing an abnormal state caused by spin-drying of the waterproof clothing in a washing machine with a drum, which accommodates the laundry, spinning around a horizontal axis (so-called a drum type washing machine) is proposed. Specifically, an acceleration sensor is installed in a water tank of the washing machine for sensing vibration in the vertical direction (in the radial direction of the drum). During low-speed rotation in the beginning of the spin-dry, the acceleration sensor detects a vibration value of the water tank, the vibration value is compared with a preset threshold to control rotation of the drum such that its revolutions per minute (rpm) is ratcheted up, and an occasion when the vibration value is greater than the threshold is determined as an abnormal state.

When the waterproof clothing is mixed into the laundry, water may happen to be enclosed by the waterproof clothing before a spin-dry process. In a drum type washing machine, during low-speed rotation in the beginning of the spin-dry, lifting and dropping the laundry is repeated, causing the waterproof clothing to be untangled, so not much residual water may be left during high-speed rotation.

On the contrary, in a vertical type washing machine in which a spin tub receiving the laundry rotates around a vertical axis, centrifugal force is applied to the laundry in the horizontal direction, and might bring about an occasion when much residual water is left even when the spin tub is rotated at high speed, causing big trouble.

Patent documents 2 and 3 propose a method for detecting such a condition. Specifically, in two different states in the beginning of a spin-dry process, a change in weight of the laundry is detected by comparing amounts of current required for rotation of the drum or deceleration time, and based on the change in weight, it is determined whether it is in such a state.

Patent documents 4 and 5 propose a method for a fully automatic washing machine to determine whether water is enclosed by clothes accommodated in a tub for both washing and spin-dry (a drum) (whether hydrated bubbles are contained) based on an amount of the clothes detected before the washing course (initial amount of clothing) and an amount of clothes detected after the rinsing course (first and second spin-dry amounts of clothing) and to perform the spin-dry based on the determination result is proposed.

PRIOR ART LITERATURE

Patent Document

Patent Document 1: JP Patent Publication No. 2012-170686

Patent Document 2: JP Patent Publication No. 2014-64918

Patent Document 3: JP Patent Publication No. 2014-64919

Patent Document 4: JP Patent Publication No. 2015-165938

Patent Document 5: JP Patent Publication No. 2015-165941

As in the patent document 1, it is hard to accurately predict abnormal vibration caused by waterproof clothing only with a vibration value of a water tank.

For example, while vibration caused by lopsided normal clothing is large from the beginning or gradually becomes larger, abnormal vibration caused by the waterproof clothing occurs when residual water abruptly starts to move during the spin-dry. As a large amount of water is moved, the vibration of the water tank increases for an instant.

Hence, determining whether vibration of the water tank is large or small is not suitable for abrupt abnormal vibration, and may not lead to prediction of abnormal vibration from the waterproof clothing.

As a portion of the waterproof clothing mixed into normal laundry is variable and a change in weight of the normal laundry is also greatly influenced by the material or type of the laundry, the method of the patent documents 2 and 3 has low accuracy and easily cause detection error.

For waterproof clothing, a situation is assumed where the waterproof clothing should be hand washed and then spin-dried, so the method that assumes a washing course as disclosed in the patent documents 4 and 5 may not deal with the situation. Furthermore, the method may not deal with a case of taking in or out the laundry on the way or a case where the laundry has been wet before being subject to the washing course.

Accordingly, an object of the disclosure is to provide a washing machine capable of accurately preventing abnormal vibration caused by waterproof clothing during the spin-dry.

SUMMARY

The disclosure relates to a washing machine that performs spin-dry by rotating a spin tub that accommodates laundry.

In accordance with an aspect of the disclosure, a washing machine includes a spin tub receiving laundry; a vibration sensor attached to a water tub that supports the spin tub inside the water tub and capable of detecting vibrations in a plurality of directions; and a processor configured to control rotation of the spin tub and determine a vibration type based on a detection value of the vibration sensor to determine whether there is waterproof clothing in the laundry.

The processor may perform two acceleration processes to accelerate rotation of the spin tub in a low-speed rotation region in the beginning of a spin-dry process, compare vibration types in the two acceleration processes, and determine whether there is the waterproof clothing in the laundry.

The processor may determine whether there is the waterproof clothing based on a change in at least one of a vibration state or an imbalance position in the first and second acceleration processes.

The processor may perform two acceleration processes to accelerate rotation of the spin tub in a low-speed rotation region in the beginning of a spin-dry process, compare detection values of the plurality of directions detected by the vibration sensor at the same preset rpm zone in the two acceleration processes, and determine whether there is the waterproof clothing in the laundry.

The processor may quantify magnitude relationships of the detection values of the plurality of directions detected in the respective acceleration processes to determine two magnitude relationship values for each of the acceleration processes, compare an amount of variation in the magnitude relationship value with a preset reference value, and determine whether there is the waterproof clothing.

The detection values of the plurality of directions may be detection values of two directions: horizontal and vertical directions.

The processor may convert the detection values of the plurality of directions to comparable values by performing absolutization and smoothing on each of the detection values of the plurality of directions.

The processor may subtract each of the detection values of the plurality of directions that is subject to the absolutization and smoothing in each of the two acceleration processes, and quantify magnitude relationships of output signals between the respective directions in each acceleration process to determine the two magnitude relationship values.

The processor may set a spin-dry rpm based on the result of determination about whether there is the waterproof clothing.

The processor may determine whether there is the waterproof clothing based on a water level variance rate in the water tub for a preset period of time when water is supplied or drained.

The washing machine may further include a water level sensor for detecting a water level in the water tub based on a change in pressure of water collected in the water tub, and the processor may determine the water level variance rate based on the detection result of the water level sensor.

The processor may determine the water level variance rate at least two or more times in different points of time.

The processor may determine whether there is the waterproof clothing based on a ratio of the two water level variance rates in the different points of time.

The processor may determine the water level variance rate when the water level is under the bottom of the spin tub.

The washing machine may further include a pulsator rotating in the spin tub to stir the laundry when a washing or rinsing process is performed, and the processor may determine whether there is the waterproof clothing based on the water level variance rate when water is supplied, and increase rpm of the pulsator to be equal to or higher than a set rpm in the washing or rinsing process performed after water supply, when it is determined that there is the waterproof clothing.

The processor may determine, based on a signal output from the vibration sensor, that there is a sign of abnormal vibration when a rhythm component having a longer period than a rotation period of the spin tub is detected or when a variance rate of vibration amplitude of the water tub is greater than a preset reference value.

The washing machine may further include a lid for opening or closing an inlet through which the laundry is taken in or out; an open/close sensor for detecting an open/closed state of the lid; and a resume switch for resuming an interrupted process, and the processor may reset a highest rpm of the spin tub in the spin-dry process to an initial state when the resume switch is manipulated after the lid is opened and closed.

After it is determined that there is the waterproof clothing, the processor may reduce a highest rpm of the spin tub to a preset rpm or less in the spin-dry process performed after the determination; sound an alarm through a notification buzzer; display an error message on a display panel; send notification of an error message to a terminal device; or stop operation.

The washing machine includes a vibration sensor attached to a water tub that supports the spin tub inside the water tub and capable of detecting vibrations in a plurality of directions; and a processor including a rotation controller for controlling rotation of the spin tub, and a first waterproof clothing determiner for determining whether waterproof clothing is mixed into the laundry based on a detection value of the vibration sensor. The rotation controller performs two acceleration processes to accelerate rotation of the spin tub in a low-speed rotation region in the beginning of a spin-dry process, and the first waterproof clothing determiner compares detection values of the plurality of directions detected by the vibration sensor at the same preset rpm zone in the two acceleration processes and determines whether there is the waterproof clothing in the laundry.

According to this washing machine, in the beginning of the spin-dry process, two acceleration processes are performed to accelerate rotation of the spin tub in the low-speed rotation region in which no abnormal vibration occurs even when the waterproof clothing is mixed in. And the detection values of the plurality of directions detected by the vibration sensor in the same preset rpm zone of the two acceleration processes are compared by the first waterproof clothing determiner, to determine whether there is the waterproof clothing.

As will be described later in detail, vibration of the spin tub during the spin-dry process has a preset pattern, and on occasions when the waterproof clothing is or is not mixed into the laundry, whether there is the waterproof clothing may be accurately determined by comparing vibration patterns in the two acceleration processes. The first waterproof clothing determiner implements the determination, and the processor is equipped with the first waterproof clothing determiner to prevent abnormal vibration in the spin-dry process, which is caused by the waterproof clothing. Using detection values of a plurality of directions may facilitate more improvement of accuracy in detection.

Specifically, the first waterproof clothing determiner may quantify magnitude relationships of the detection values of the plurality of directions detected in the respective acceleration processes to determine two magnitude relationship values for each of the acceleration processes, compare an amount of variation in the magnitude relationship value with a preset reference value, and determine whether there is the waterproof clothing.

This enables highly accurate determination with relatively simple calculation.

Furthermore, the processor may be equipped with a waterproof clothing pre-determiner for determining whether there is waterproof clothing based on a water level variance rate that represents an amount of variation of water level in the water tub for a certain period of time when water is supplied or drained.

This enables determination of whether there is waterproof clothing based on two different mechanisms, thereby more reliably preventing abnormal vibration caused by the waterproof clothing in the spin-dry process.

In this case, the washing machine further includes a water level sensor for detecting a water level in the water tub based on a change in pressure of water stored in the water tub, and the waterproof clothing pre-determiner may calculate the water level variance rate based on a detection value of the water level sensor.

Furthermore, the waterproof clothing pre-determiner may calculate the water level variance rate at least two times or more at different points of time, and the waterproof clothing pre-determiner may determine whether there is the waterproof clothing based on a ratio of two of the water level variance rates at the different points of time.

Specifically, the waterproof clothing pre-determiner may calculate the water level variance rate when the water level is under the bottom of the spin tub.

The washing machine may further include a pulsator rotating in the spin tub to stir the laundry when a washing or rinsing process is performed, and the waterproof clothing pre-determiner may determine whether there is the waterproof clothing based on the water level variance rate when water is supplied, and the rotation controller may increase rpm of the pulsator to be equal to or higher than a set rpm in the washing or rinsing process performed after water supply, when it is determined that there is the waterproof clothing.

Especially, the washing machine may further include driving motor having a single ring-shaped stator and two rotors each of which is capable of independently rotating against the stator, and it is desirable that one end of the rotor is coupled to the spin tub and the other end of the rotor is coupled to the pulsator.

When it is determined that there is the waterproof clothing, the rotation controller may reduce the highest rpm of the spin tub to a preset rpm or less in the spin-dry process performed after the determination.

Furthermore, the processor may include a sign detector for detecting a sign of abnormal vibration of the water tub occurring in the spin-dry process based on a detection value of the vibration sensor.

When it is determined that there is the waterproof clothing, a certain notification may be sent or the operation may be stopped.

The washing machine may further include a lid for opening or closing an inlet through which the laundry is taken in or out; an open/close sensor for detecting an open/closed state of the lid; and a resume switch for resuming an interrupted process, and when the resume switch is manipulated after the lid is opened and closed, it may reset a highest rpm of the spin tub to an initial state in the spin-dry process performed after that.

The washing machine may further include a communicator allowing wireless communication with an external terminal device and may send notification information to the terminal device through the communicator.

The disclosure relates to a washing machine that performs spin-dry by rotating a spin tub that accommodates laundry.

The washing machine may include a rotation controller for controlling rotation of the spin tub, and a second waterproof clothing determiner for determining whether waterproof clothing is mixed into the laundry based on the rpm of the spin tub. In the beginning of the spin-dry process, the rotation controller may perform a rotation maintenance process to accelerate rotation of the spin tub to a preset maintenance rpm in a low-speed rotation region and maintain the maintenance rpm. The second waterproof clothing determiner may determine whether there is the waterproof clothing based on an amount of shaking of rotation occurring when the spin tub reaches the maintenance rpm.

It may be determined whether there is waterproof clothing from an inertial difference of the spin tub in the washing machine, so on an occasion when the waterproof clothing mixed into the laundry sticks to the spin tub, hindering draining of water, determination of whether there is the waterproof clothing may be made accurately.

The spin tub may be rotated by the rotation controller controlling the driving motor, and the second waterproof clothing determiner may detect an amount of shaking of the rotation from a control voltage of the driving motor.

This may enable the determination through an existing device, thereby avoiding structural complexity and reducing costs of the members.

The second waterproof clothing determiner may include a preset reference value, and determine that there is the waterproof clothing when the amount of shaking of rotation exceeds the reference value.

This enables the reference value to be adjusted to the situation, securing reliability of determination and giving good versatility.

In this case in particular, the second waterproof clothing determiner may include a plurality of reference values set every lapse of certain time after the maintenance rpm is reached, compare the reference value and the amount of shaking of rotation corresponding to the reference value, and determine that there is the waterproof clothing when the amount of shaking of rotation exceeds the reference value.

This may significantly increase the number of times of determination while avoiding the burden of calculation, thereby making efficient and accurate determination.

Furthermore, in the beginning of the spin-dry process, the rotation controller may perform a second rotation maintenance process to accelerate rotation to a second maintenance rpm lower than the maintenance rpm and maintain the second maintenance rpm, and the processor may further include a first detection error avoider for determining that there is no waterproof clothing based on a ratio of a growth rate of the amount of shaking of rotation to a growth rate of the second amount of shaking of rotation occurring when the spin tub reaches the second maintenance rpm, and the second waterproof clothing determiner may not perform determination when the first detection error avoider determines that there is no waterproof clothing.

This may exclude a pattern that causes detection error before determination is made by the second waterproof clothing determiner, thereby improving accuracy in determination of whether there is waterproof clothing, which is performed by the second waterproof clothing determiner.

In this case, the first detection error avoider includes a preset first threshold, and may determine that there is no waterproof clothing when the ratio of growth rates exceeds the first threshold.

This enables the first threshold to be adjusted to the situation, securing reliability of determination of detection error which is performed by the first detection error avoider and giving good versatility.

Furthermore, the washing machine includes a vibration sensor attached to a water tub supporting the spin tub inside the water tub and capable of detecting vibration, and the processor may further include a second detection error avoider for determining that there is no waterproof clothing based on the detection value detected by the vibration sensor at certain rpm in the beginning of the spin-dry process, and the second waterproof clothing determiner may not perform determination when the second detection error avoider determines that there is no waterproof clothing.

This may exclude a pattern that causes detection error by using a mechanism different from the first detection error avoider before determination is made by the second waterproof clothing determiner, thereby further improving accuracy in determination of whether there is waterproof clothing, which is performed by the second waterproof clothing determiner.

In this case, the second detection error avoider may include a plurality of preset second thresholds corresponding to different detection directions of the vibration sensor and/or different rpm, compare the second threshold and corresponding detection value of the vibration sensor, and determine that there is no waterproof clothing when the detection value exceeds the second threshold in the comparison.

This enables the second threshold to be adjusted to the situation, securing reliability of determination of detection error which is performed by the second detection error avoider and giving good versatility. It is possible to efficiently increase the number of determinations and make accurate determination.

In this way, when the second waterproof clothing determiner determines that there is the waterproof clothing, the rotation controller may reduce the highest rpm of the spin tub to a preset rpm or less in the spin-dry process performed after the determination, or may send a certain notification.

This may enable abnormal vibration caused by waterproof clothing during the spin-dry to be prevented with high accuracy.

The disclosure relates to a washing machine including a spin tub arranged to be rotated in a water tub, a driver for driving rotation of the spin tub, and a processor for controlling the driver to perform a spin-dry process.

The washing machine also includes a load detector for detecting a rotation load of the spin tub, a calculator for calculating an amount of variation of the rotation load for a certain period during the spin-dry process based on a detection result of the load detector, and a determiner for determining whether there is a sign of abnormal vibration based on the result of calculation of the calculator.

According to the configuration, the determiner determines whether there is a sign of abnormal vibration (specifically, whether there is waterproof clothing that encloses water) based on the amount of variation of the rotation load for the certain period during the spin-dry process.

Specifically, when the spin-dry is performed on the laundry with normal clothing but no waterproof clothing mixed thereto, the rotation load, e.g., the torque voltage as well as the amount of variation of an acceleration or deceleration load of rotation, becomes small. For example, when the rpm is being uniformly accelerated without a hitch, water gets drained by the increase in rpm, leading to reduction in weight of the laundry and thus gradual reduction in the amount of variation of acceleration or deceleration load of rotation.

On the other hand, when the waterproof clothing that encloses water is mixed into the laundry, the amount of variation of acceleration or deceleration load of rotation becomes large. In this case, the water enclosed by the waterproof clothing is not released even in the spin-dry process, and the weight of the laundry is not reduced unlike the occasion when there is the normal clothing only. Hence, the amount of variation of acceleration or deceleration load of rotation relatively becomes large.

According to the above configurations, by taking into account the amount of variation of rotation load, e.g., when an average of the respective amounts of variation of rotation loads detected for a plurality of periods during the spin-dry process is greater than a certain value, it is determined that there is a sign of abnormal vibration, i.e., that the waterproof clothing that encloses water is mixed into the laundry.

Because the determination is supposed to made by referring to detection results in the spin-dry process, it may deal with a situation in which the spin-dry process is only performed without washing or rinsing process. Such a situation is assumed particularly for the waterproof clothing, and is thus effective to prevent abnormal vibration caused by the waterproof clothing.

With the above configuration, before abnormal vibration occurs, the sign may be determined in time.

Furthermore, the certain period is set in the plural during the spin-dry process, and the calculator may calculate the amount of variation for each of the certain periods as well as an index that represents an average of the amounts of variation, and the determiner may compare the average with a certain value based on the index as well as determine that there is a sign of abnormal variation when the average is greater than the certain value.

The "average" of the amounts of variation includes an arithmetic average and a geometric average of the amounts of variation.

With the above configurations, based on amounts of variation calculated for the plurality of certain periods, the calculator calculates the index that represents the average of them. The determiner then compares the average of amounts of variation with a threshold based on the index. When the average is greater than the certain value, it may be determined that there is a sign of abnormal vibration, e.g., that waterproof clothing that encloses water is mixed into the laundry.

As such, comparison is made on the average of amounts of variation instead of the amounts of variation themselves, thereby suppressing influence of detection error of the rotation load, and having the benefit of proper determination of a sign of abnormal vibration before the abnormal vibration occurs.

Furthermore, the washing machine may include a spin tub arranged to be rotated in a water tub, a driver for driving rotation of the spin tub, and a processor for controlling the driver to perform a spin-dry process, and also includes a load detector for detecting a rotation load of the spin tub, a calculator for calculating an arithmetic average of the rotation load for a certain period during the spin-dry process based on a detection result of the load detector, and a determiner for determining whether there is a sign of abnormal vibration based on the result of calculation of the calculator.

According to the configuration, the determiner determines whether there is a sign of abnormal vibration (specifically, whether there is waterproof clothing that encloses water) based on the arithmetic average of the rotation load for the certain period during the spin-dry process.

Specifically, when the laundry contains only the normal clothing but the waterproof clothing, water contained in the normal clothing is released and the weight of the laundry becomes light by performing a spin-dry process. The arithmetic average of the rotation load becomes small as much as it gets light.

On the other hand, when there is the waterproof clothing that encloses water contained in the laundry, the water is not sufficiently released even with the spin-dry process and the change in weight is small as compared to the occasion when there is the normal clothing only. Hence, as compared to the occasion when there is the normal clothing only, the arithmetic average of the rotation load is relatively large.

According to the above configurations, by taking into account the arithmetic average of the rotation load, e.g., by calculating the arithmetic average for each of the plurality of periods during the spin-dry process, it is determined that there is a sign of abnormal vibration, i.e., that the waterproof clothing that encloses water is mixed into the laundry when an average value of the arithmetic average is greater than a certain value.

Because the determination is supposed to made by referring to detection results in the spin-dry process, it may deal with a situation in which the spin-dry process is only performed without washing or rinsing process. Such a situation is assumed particularly for the waterproof clothing, and is thus effective to prevent abnormal vibration caused by the waterproof clothing.

With the above configuration, before abnormal vibration occurs, the sign may be determined in time.

Furthermore, the washing machine may include a spin tub arranged to be rotated in a water tub, a driver for driving rotation of the spin tub, and a processor for controlling the driver to perform a spin-dry process, and also includes a load detector for detecting a rotation load of the spin tub, a calculator for calculating a maximum value of the rotation load for a certain period during the spin-dry process based on a detection result of the load detector, and a determiner for determining whether there is a sign of abnormal vibration based on the result of calculation of the calculator.

According to the configuration, the determiner determines whether there is a sign of abnormal vibration (specifically, whether there is waterproof clothing that encloses water) based on the maximum value of the rotation load for the certain period during the spin-dry process.

Specifically, when the laundry contains only the normal clothing but the waterproof clothing, water contained in the normal clothing is released and the weight of the laundry becomes light by performing a spin-dry process. The maximum value of the rotation load becomes small as much as it gets light.

On the other hand, when there is the waterproof clothing that encloses water contained in the laundry, the water is not sufficiently released even with the spin-dry process and the change in weight is small as compared to the occasion when there is the normal clothing only. Hence, as compared to the occasion when there is the normal clothing only, the maximum value of the rotation load is relatively large.

According to the above configurations, by taking into account the maximum value of the rotation load, e.g., by determining the maximum value for each of the plurality of periods during the spin-dry process, it is determined that there is a sign of abnormal vibration, i.e., that the waterproof clothing is mixed into the laundry and water is enclosed by the waterproof clothing when the maximum value is greater than a certain value.

Because the determination is supposed to made by referring to detection results in the spin-dry process, it may deal with a situation in which the spin-dry process is only performed without washing or rinsing process. Such a situation is assumed particularly for the waterproof clothing, and is thus effective to prevent abnormal vibration caused by the waterproof clothing.

With the above configuration, before abnormal vibration occurs, the sign may be determined in time.

Furthermore, the processor may control operation of the driver to rotate the spin tub at speed equal to or lower than a preset rpm in the spin-dry process when the determiner determines that there is a sign of abnormal vibration.

With the configuration, when the waterproof clothing that encloses water is accommodated in the spin tub and it is determined that there is a sign of abnormal vibration, the processor controls the spin tub to rotate at speed equal to or less than a certain rpm in the spin-dry process. For example, in a case that the highest rpm of the spin tub is set to about 700 rpm in a normal spin-dry process, when it is determined that there is a sign of abnormal vibration, a maximum rpm of the spin tub may be set to about e.g., 500 rpm for the spin-dry process.

Accordingly, occurrence of abnormal vibration caused by the waterproof clothing that encloses water may be prevented and the spin-dry process may be completed without stopping the operation of the washing machine.

Furthermore, it may also be fine for the load detector to detect the rotation load while the spin tub is being accelerated without a hitch.

Moreover, the processor may control the driver to perform a preliminary spin-dry process to accelerate the spin tub to a certain first rpm and maintain the rotation at the first rpm and a main spin-dry process to accelerate the spin tub to a certain second rpm higher than the first rpm and maintain the rotation at the second rpm, and the load detector may detect the rotation load in both the preliminary spin-dry process and the main spin-dry process.

According to the disclosure, a washing machine may accurately prevent abnormal vibration caused by waterproof clothing during the spin-dry.

DETAILED DESCRIPTION

Embodiments of the disclosure will now be described in more detail based on accompanied drawings. However, they are just for illustration, and not intended to limit the disclosure, applications, or purposes.

A washing machine capable of accurately determining whether waterproof clothing is mixed into the laundry in a state of being likely to cause abnormal vibration in a spin-dry process, and preventing the abnormal vibration during the spin-dry will be described in detail in first to third embodiments, separately.

First Embodiment

<Structure of Washing Machine>

Figure 1:
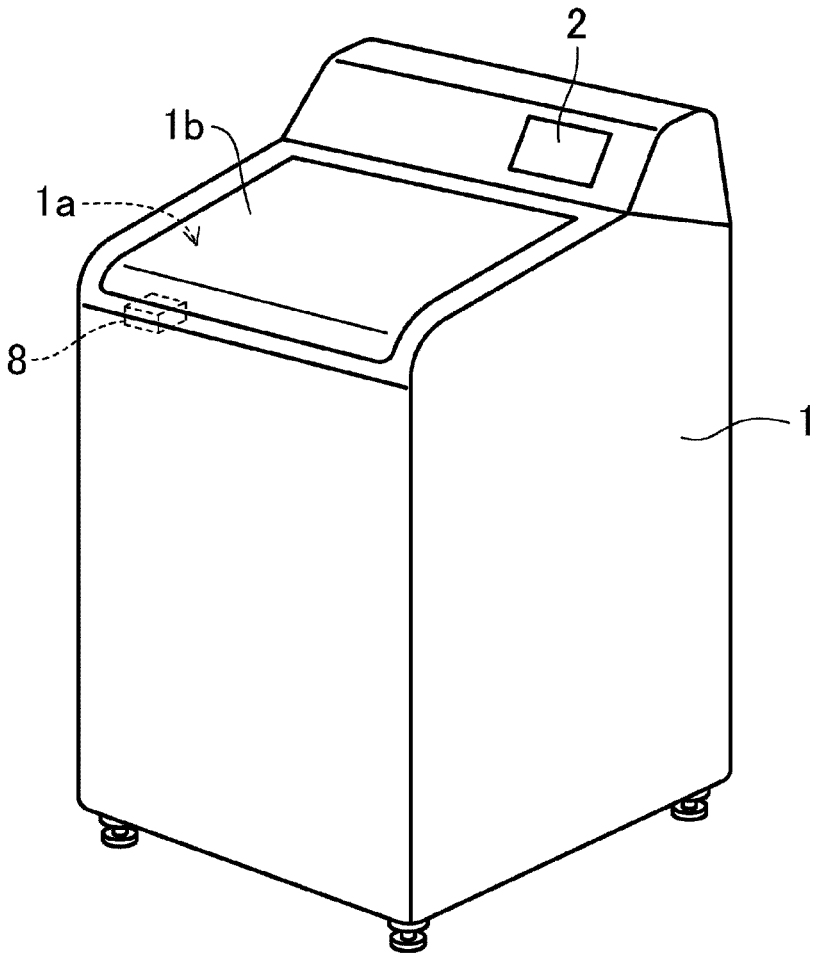
FIG. 1 is a schematic perspective view illustrating an overall structure of a washing machine, according to a first embodiment of the disclosure.
Figure 2:
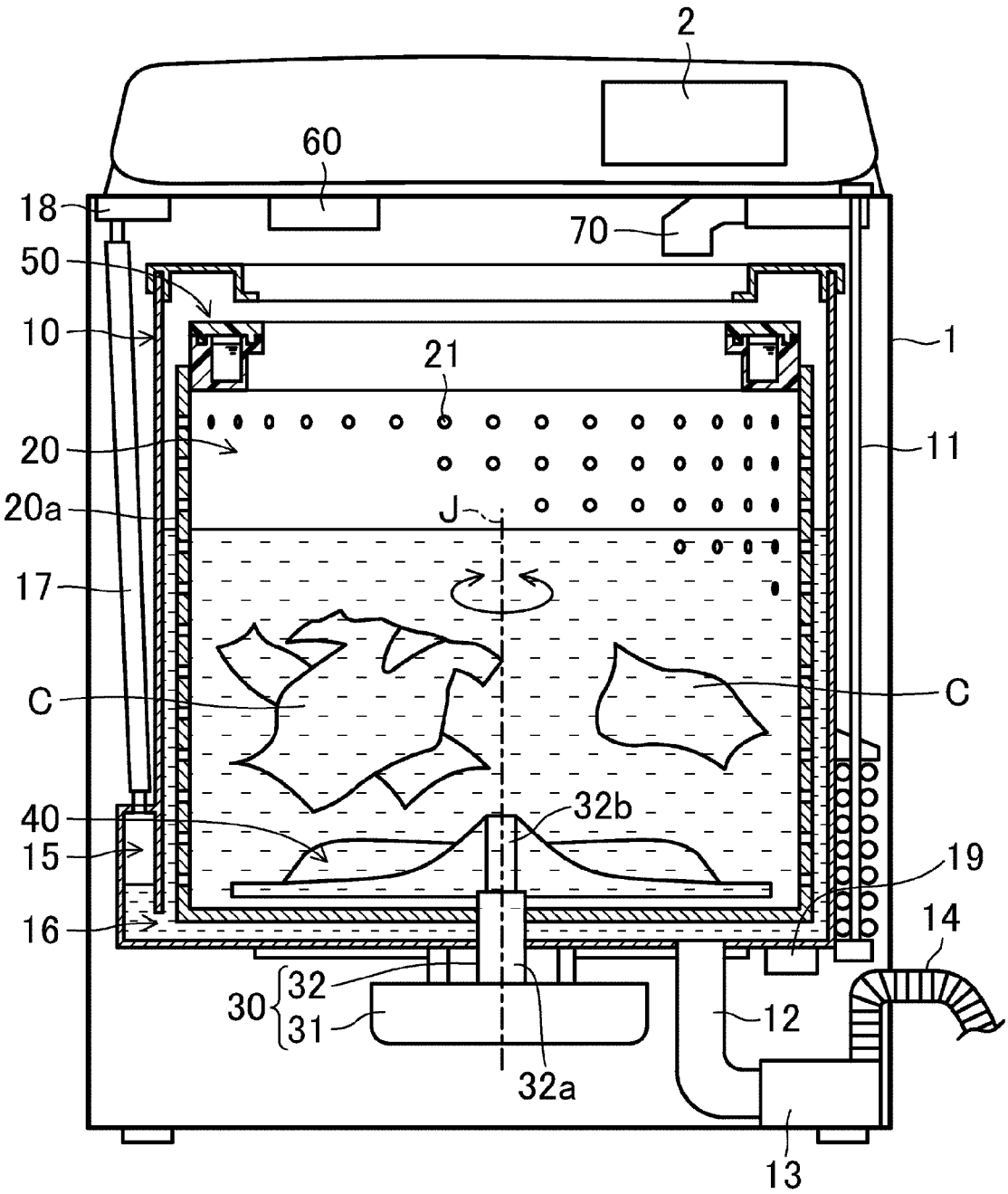
FIG. 2 is a schematic longitudinal section view illustrating an internal structure of a washing machine.

FIGS. 1 and 2 show a washing machine in the first embodiment. The washing machine is a so-called vertical type of full automatic washing machine having a case 1 in the shape of a rectangular box with an inlet 1*a* installed on the top that is opened or closed with a lid 1*b*. Laundry C is taken in or out through the inlet 1*a*. An operator 2 is installed behind the inlet 1*a*, allowing the user to manipulate the operator 2 to successively and automatically perform processes of "water supply", "washing", "rinsing", or "spin-dry".

A water tub 10, a spin tub 20, a driving motor 30, a pulsator 40, a balancer 50, a processor 60, etc., are installed inside the case 1.

The water tub 10 is comprised of a container shaped like a cylinder that has a bottom part and is opened upward, and is arranged in the center of the case 1. The water tub 10 is elastically supported against the case 1 to sway and move inside the case 1 while being suspended by a plurality of suspensions 11.

The spin tub 20 is comprised of a container smaller than the water tub 10 and shaped like a cylinder that has a bottom part and is opened upward, and received inside the water tub 10 with the mutual center aligned with a vertical axis J. A plurality of water-drain holes 21 passing through the circumferential wall 20*a* are formed all across a circumferential wall 20*a* of the spin tub 20.

The pulsator 40 is arranged on the bottom of the spin tub 20. The pulsator 40 is formed of a member shaped like a disc with a plurality of wing-type projections radially arranged on the top. The laundry C are thrown into the spin tub 20, and each of a washing process or a spin-dry process is performed while the spin tub 20 accommodates the laundry C.

The spin tub 20 is supported against the water tub 10 to be freely rotated therein, and the rotation is driven around the vertical axis J by the driving motor 30 installed on the other side of the bottom part of the water tub 10. Specifically, the driving motor 30 includes a main motor body 31 and a power transmitter 32. The power transmitter 32 has a first rotation shaft 32*a* and a second rotation shaft 32*b*, each center of which is aligned with the vertical axis J.

The first rotation shaft 32*a* penetrates the bottom wall of the water tub 10 and is attached onto the bottom wall of the spin tub 20. The second rotation shaft 32*b* penetrates the bottom walls of the water tub 10 and spin tub 20, protruding into the spin tub 20 with the protruding end attached to the center of the pulsator 40.

The power transmitter 32 changes the direction of rotation of each of the first and second rotation shafts 32*a* and 32*b* based on each process. Accordingly, the first and second rotation shafts 32*a* and 32*b* are enabled to rotate forward or backward, or turn reversely from forward or backward rotation, separately or all in one. For example, in a washing or rinsing process, the second rotation shaft 32*b* only is driven and the pulsator 40 is rotated while turning reversely at certain intervals without rotation of the spin tub 20. In a spin-dry process, the first and second rotation shafts 32*a* and 32*b* are driven all in one, and the spin tub 20 and the pulsator 40 rotate together at high speed in a certain direction.

The balancer 50 is a member shaped like a round ring, and installed at the top end of the circumferential wall 20*a*. The balancer 50 is sealed to allow high-density liquids such as salty water, a plurality of balls, or something to be moved therein. With the balancer 50, during high-speed rotation of the spin tub 20, imbalance caused by a lopsided distribution of the laundry C is canceled, and vibration in the spin-dry process may be suppressed.

A drain hose 12 or a drain pump 13 is installed under the water tub 10 inside the case 1. The drain hose 12 has an end coupled to the bottom wall of the water tub 10 and the other end coupled to an inlet of the drain pump 13. An outlet of the drain pump 13 is coupled to an outside hose 14 extending out from the case 1.

On the upper side in the case 1, a water supply device 70 is installed to supply water into the water tub 10 before the wash or rinse process. The water supply device 70 is structured to drop a certain amount of water into the water tub 10 through the opening of the spin tub 20 at a certain flow rate.

On the lower side of the outer surface of the circumferential wall of the water tub 10, a sealed room 15 shaped like a small box is installed in one unit. The sealed room 15 is linked to the inside of the water tub 10 through a linkage hole 16, which is opened at a lower corner of the water tub 10. The lower end of a sub hose 17 extending vertically along the circumferential wall of the water tub 10 is attached onto the top of the sealed room 15. The upper end of the sub hose 17 is coupled to a water level sensor 18. The water level sensor 18 and the sealed room 15 are linked together through the sub hose 17 in a sealed state.

Accordingly, once the water is supplied from the water supply device 70 into the water tub 10, some of the water is also supplied to the sealed room 15 through the linkage hole 16. When the water level of the water tub 10 is changed, the water pressure of the water stored in the water tub 10 is changed as well, which also leads to a change in air pressure in the sealed room 15. The water level sensor 18 outputs an oscillation frequency to the processor 60 based on the change in air pressure, and the processor 60 detects a water level in the water tub 10 from the oscillation frequency.

A vibration sensor 19 is attached onto the other side of the bottom wall of the water tube 10. The vibration sensor 19 is a sensor for detecting accelerations of the water tub 10 in multiple directions. In this washing machine, the vibration sensor 19 is attached to detect accelerations in two horizontal directions and three vertical directions.

As shown in FIG. 1, an open/close sensor 8 is attached onto a quaquaversal part of the inlet 1*a* of the case 1. The open/close sensor 8 is to detect an open or closed state of the lid 1*b*, and is comprised of a proximity sensor or a magnetic sensor. For example, in a case of the magnetic sensor, the lid 1*b* has a permanent magnet (not shown) installed on the other side of the lid 1*b*, and the open/close sensor 8 is arranged anywhere to be opposite to the permanent magnet.

(Processor)

The processor 60 is installed on the upper side in the case 1. The processor 60 includes hardware such as a CPU, a memory, etc., and software such as a control program, and has ability to control overall operation of the washing machine. Specifically, the processor 60 controls the number of rotations (rpm) for the driving motor 30 or the change in direction of rotation of the power transmitter 32 and perform each process of water supply, washing, intermediate spin-dry, rinsing, draining, spin-dry, etc., according to the control program.

Figure 3:
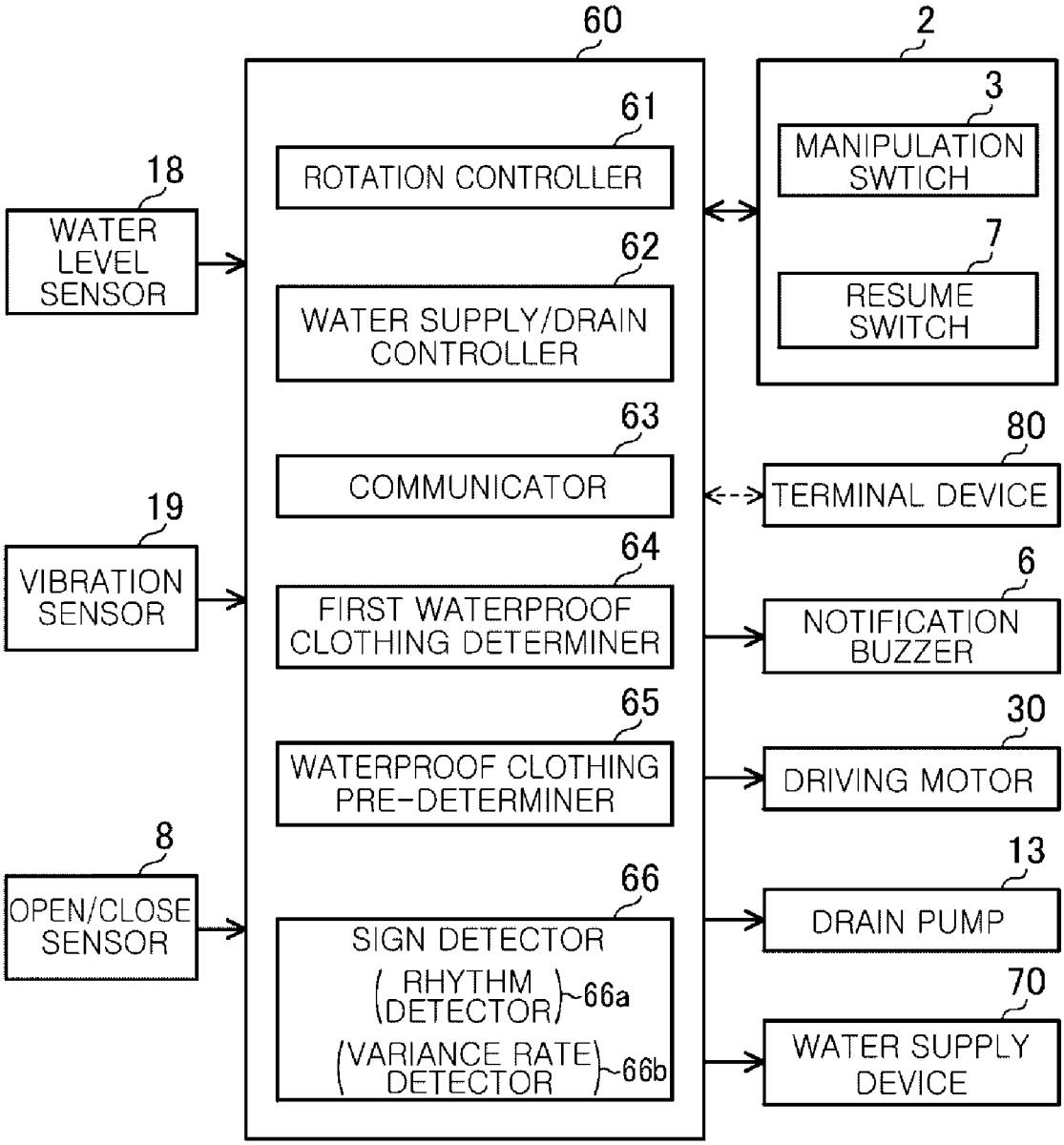
FIG. 3 is a block diagram illustrating relationships between a processor and the respective components of a washing machine.

FIG. 3 shows relationships between the processor 60 and the respective components of a washing machine. The processor 60 is connected to the water level sensor 18, the vibration sensor 19, or the open/close sensor 8 as an input device, and to the operator 2 as an input/output device. The operator 2 has an operation switch 3 or a resume switch 7 installed thereon. The processor 60 is also configured to have access to an external terminal 80, such as a smart phone, a tablet, etc., as an input/output device. Furthermore, as an output device, a notification buzzer 6, the driving motor 30, the drain pump 13, and the water supply device 70 are coupled to the processor 60.

The processor 60 also has a rotation controller 61, a water supply/drain controller 62, a communicator 63, a first waterproof clothing determiner 64, a waterproof clothing pre-determiner 65, a sign detector 66, etc., installed therein. The rotation controller 61 controls operation of the driving motor 30 to control rotation of the spin tub 20 or the pulsator 40, and the water supply/drain controller 62 controls operation of the drain pump 13 or the water supply device to drain water or supply water. The communicator 63 enables wireless communication between the processor 60 and the terminal 80, and the processor 60 may send notification information such as an error message to the terminal 80 through the communicator 63.

The first waterproof clothing determiner 64, the waterproof clothing pre-determiner 65, and the sign detector 66 constitute anti-abnormal-vibration device for preventing abnormal vibration during the spin-dry, which will be described later in detail.

<Each Process in Washing Machine>

While the laundry C is received in the spin tub 20, a series of processes of washing, rinsing, spin-dry, etc., are started when the user manipulates the operation switch 3 to select an operation mode.

(Washing, Rinsing)

While the drain pump 13 is stopped, water is supplied into the spin tub 20 from the water supply device 70 until a certain amount of water is stored in the water tub 10 and the spin tub 20 based on the laundry C. For the washing process, a detergent is further added to the stored water. In this state, the laundry C is stirred along with the water by reversely turning the pulsator 40 forward and backward without rotating the spin tub 20.

(Intermediate Spin-Dry Process, Spin-Dry Process)

After the rinsing process is finished, the drain pump 13 is activated for the water to be drained from the water tub 10. In this state, the spin tub 20 is controlled by the rotation controller 61 to be rotated together with the pulsator 40 in a certain direction. The spin tub 20 is accelerated until reaching the highest rpm (spin-dry rpm) that exceeds 1,000 rpm, and then rotates at the spin-dry rpm for a certain period of time.

As a result, the water contained in the laundry C is discharged out of the spin tub 20 through the water drain holes 21 by the action of centrifugal force. The water discharged from the spin tub 20 is drained out through the drain hose 12 and the outside hose 14.

The spin-dry process is performed in the last of the series of the processes, but in some operation mode, washing or rinsing process is repeated in the middle of the series of the processes, in which case an intermediate spin-dry process is sometimes performed between rinsing and washing processes (herein, the intermediate spin-dry process and the spin-dry process are collectively called the spin-dry process).

<Apparatus for Preventing Abnormal Vibration during Spin-Dry>

When the laundry C has just ordinary water-permeable clothes, such as underwear, shirts, sweaters, etc., (hereinafter, also called normal clothing Cn), water collected into the spin tub 20 through the normal clothing Cn and the water drain holes 21 may be discharged out without a hitch. Hence, the spin tub 20 is dried and becomes light-weighted in the spin-dry process, so even when the laundry C is significantly lopsided, the balancer 50 may catch up with the change of the imbalance and thus no abnormal vibration occurs.

However, if some clothes through which no or little water passes (herein, collectively called waterproof clothing Cwp) such as waterproof or water-repellent clothes, water-impermeable products (e.g., raincoats or nylon bed covers), etc., are mixed into the laundry C, the waterproof clothing Cwp interferes with water draining, so residual water is formed in the spin tub 20 in a troublesome state for draining.

In this case, during the spin-dry process, the residual water abruptly starts moving, causing vibrations of the spin tub 20 and water tub 10 (also called a spin tub 20 and the like) to grow for an instant to an abnormal vibration as if to break down the washing machine.

Hence, in this washing machine, an apparatus for preventing abnormal vibration caused by the waterproof clothing Cwp is configured in multiple ways. Specifically, based on different mechanisms, first and second determination apparatuses for determining whether there is the waterproof clothing Cwp, or a prediction apparatus for detecting a sign of abnormal vibration is installed.

(First Determination Apparatus for Determining Whether Waterproof Clothing Cwp is Present)

When the waterproof clothing Cwp is mixed into the laundry C, a condition in which water is enclosed by the waterproof clothing Cwp (a water-saturated condition) may sometimes occur before the spin-dry process. The water-saturated condition is not necessarily limited to a condition in which the water is fully enclosed, but includes a condition in which water does not escape with the centrifugal force that acts in the spin-dry process. The water-saturated condition typically occurs no matter how it is big or small, when there is the waterproof clothing Cwp. It does not matter when the amount of the residual water is small, but it does matter when there is much residual water.

Figure 4:
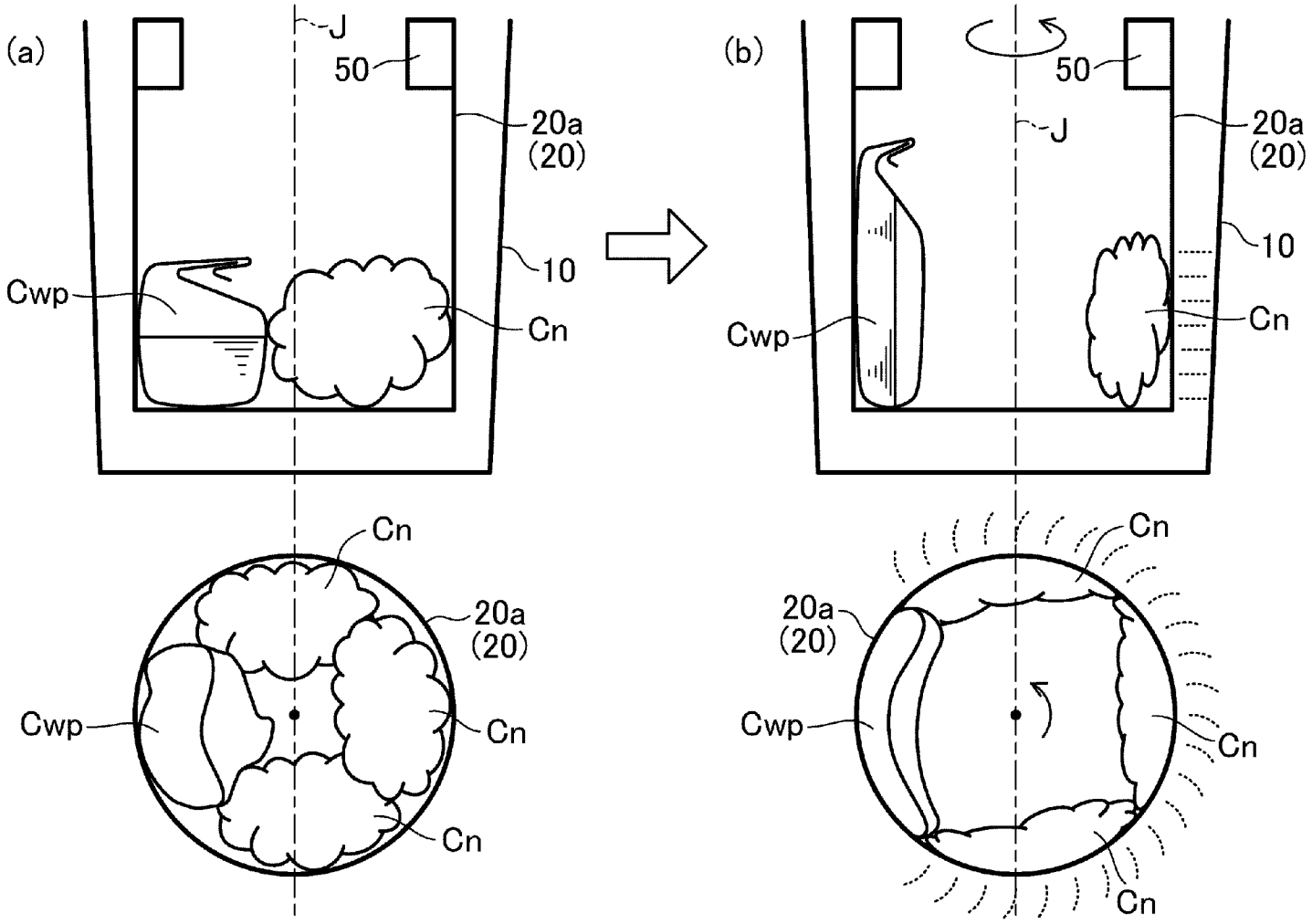
FIG. 4 is a view for explaining water-saturated conditions, where (a) shows a condition before the start of spin-dry, and (b) shows a condition during the spin-dry.

FIG. 4 shows the water-saturated condition in (a). When the spin-dry process is performed in the spin tub 20 in which the water-saturated condition occurs, and the spin tub 20 is accelerated, as shown in (b) of FIG. 4, the water-saturated waterproof clothing Cwp or the normal clothing Cn may gather onto the circumferential wall 20*a* of the spin tub 20 due to the centrifugal force. As the normal clothing Cn is spin-dried, it becomes less weighted and sticks to the circumferential wall 20*a* without moving. On the contrary, the weight of the waterproof clothing Cwp almost remains unchanged, and with the increased rpm, the centrifugal force acts on the internal water to be moved upward and stick to the circumferential wall 20*a*.

Accordingly, in the spin tub 20, an imbalance position of the waterproof clothing Cwp and an imbalance position of the normal clothing Cn are opposed to each other, and the water inside the waterproof clothing Cwp moves up and down, thereby making the spin tub 20 shaking significantly in thee dimensions and causing abnormal vibration.

Figure 5:
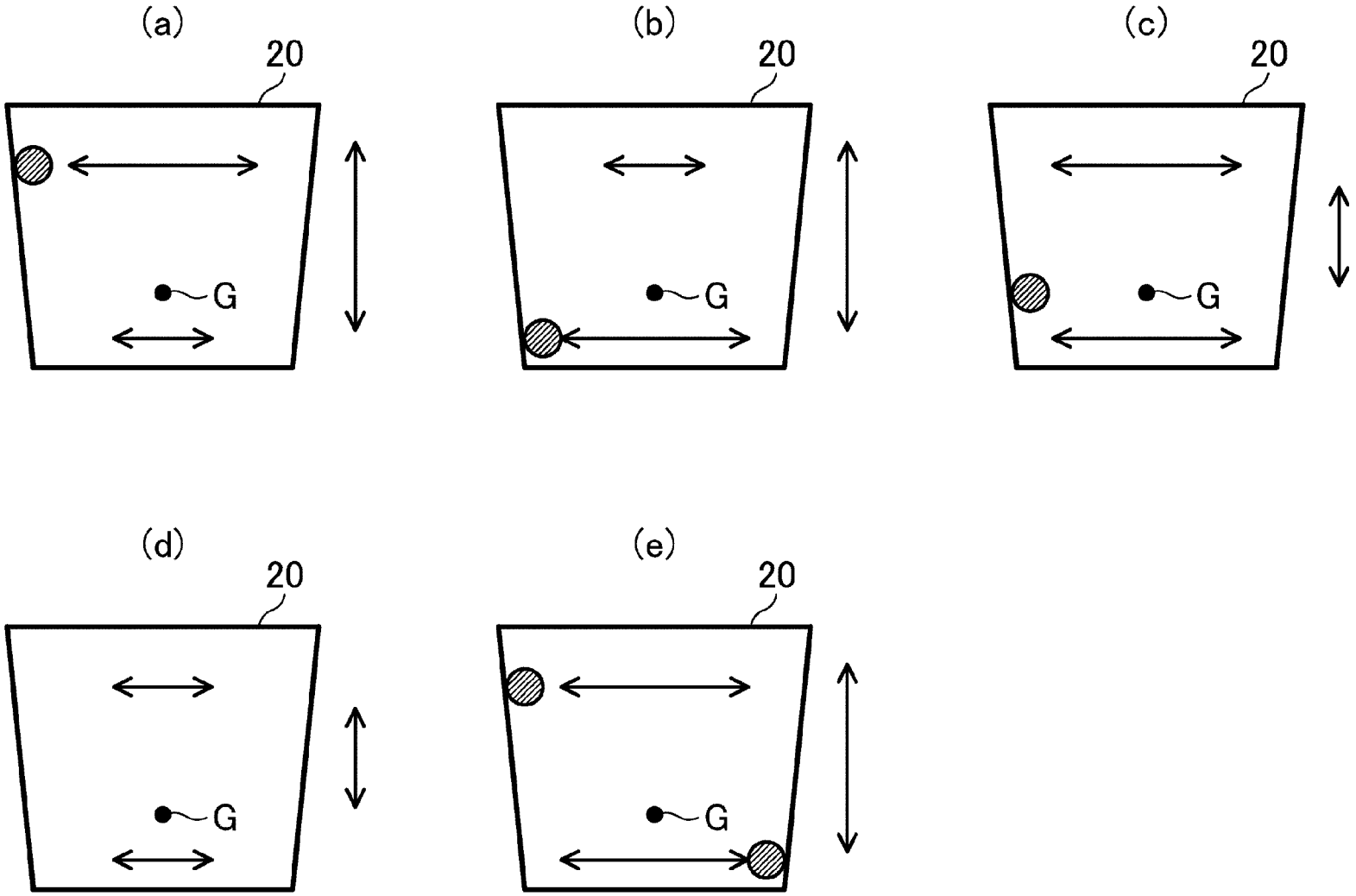
FIG. 5 shows vibration types (a) to (e) of a spin tub in a spin-dry process.

In this spin-dry process, the inventors of the disclosure construe that the types of vibration of the spin tub 20 or the like may be classified based on vibration states and imbalance positions into five patterns as shown in FIG. 5.

In each pattern view, arrows indicate direction and magnitude of the vibration, and a (shaded) circular mark indicates an imbalance position. Furthermore, symbol G indicates a physical center of the spin tub 20 or the like.

The term imbalance position refers to a location to which a solid weight (imbalance) is attached to the spin tub 20 to reconstruct vibration that occurs in the water tub 10 in an actual spin-dry for clothes thrown in. That is, the laundry contained in the spin tub 20 and their lopsided distribution are represented by replacement with the size and attached position (which is the surface of the wall of the spin tub 20 due to the centrifugal force) of the weight.

In other words, the imbalance position corresponds to a position at which analogous vibration occurs without the laundry C by placing a weight at the position which weighs the same as the total weight of the laundry C with lopsided distribution. In addition, the weight weighs as much as an amount of imbalance. A typical vibration test is performed by attaching weights to top and bottom of the wall (sometimes the center position) of the spin tub 20 to change the weight, so the imbalance position is commonly used in vibration tests.

(a) of FIG. 5 shows a pattern of an occasion when the laundry C is lopsidedly distributed on the upper side of the spin tub 20. The imbalance position is above the center, and the spin tub 20 or the like significantly moves up and down such that the upper portion of the spin tub 20 is shaken in the radial direction more largely than the lower portion.

(b) of FIG. 5 shows a pattern of an occasion when the laundry C is lopsidedly distributed on the lower side of the spin tub 20. The imbalance position is below the center, and the spin tub 20 or the like significantly moves up and down such that the lower portion of the spin tub 20 is shaken in the radial direction more largely than the upper portion.

(c) of FIG. 5 shows a pattern of an occasion when the laundry C is lopsidedly distributed in the middle of the spin tub 20. The imbalance position is at almost the same level as the center, and the spin tub 20 or the like moves mildly up and down such that the lower portion and the upper portion of the spin tub 20 are almost in sync with each other and significantly shaken in the radial direction.

(d) of FIG. 5 shows a pattern of an occasion when the laundry C is distributed with good balance in the spin tub 20. The spin tub 20 is balanced well, so it mildly moves up and down and sways.

(e) of FIG. 5 shows a pattern shown in the normal clothing Cn and particularly shown in a case where the waterproof clothing Cwp is mixed into the laundry C and the water-saturated condition occurs. The imbalance position of the normal clothing Cn and the imbalance position of the waterproof clothing Cwp are on the opposite upper and lower sides, and the spin tub 20 or the like largely moves up and down and the upper and lower portions thereof are shaken largely in the radial direction.

Where there is only normal clothing Cn in the laundry C, as described above, the weight is changed because it is reduced, but the imbalance position almost remains unchanged because the water drains almost evenly.

Accordingly, in the beginning of the spin-dry process, two acceleration processes are performed to accelerate rotation of the spin tub 20 or the like in a low-speed rotation region, and whether the waterproof clothing Cwp is present is determined by comparing vibration types in the two acceleration processes.

Specifically, when the laundry C includes only the normal clothing Cn, its weight is changed but the imbalance position remains almost unchanged in the first and second acceleration processes. On the contrary, when the waterproof clothing Cwp is mixed into the laundry C and the water-saturated condition occurs, both the weight and the imbalance position are changed in the first and second acceleration processes.

Figure 6:
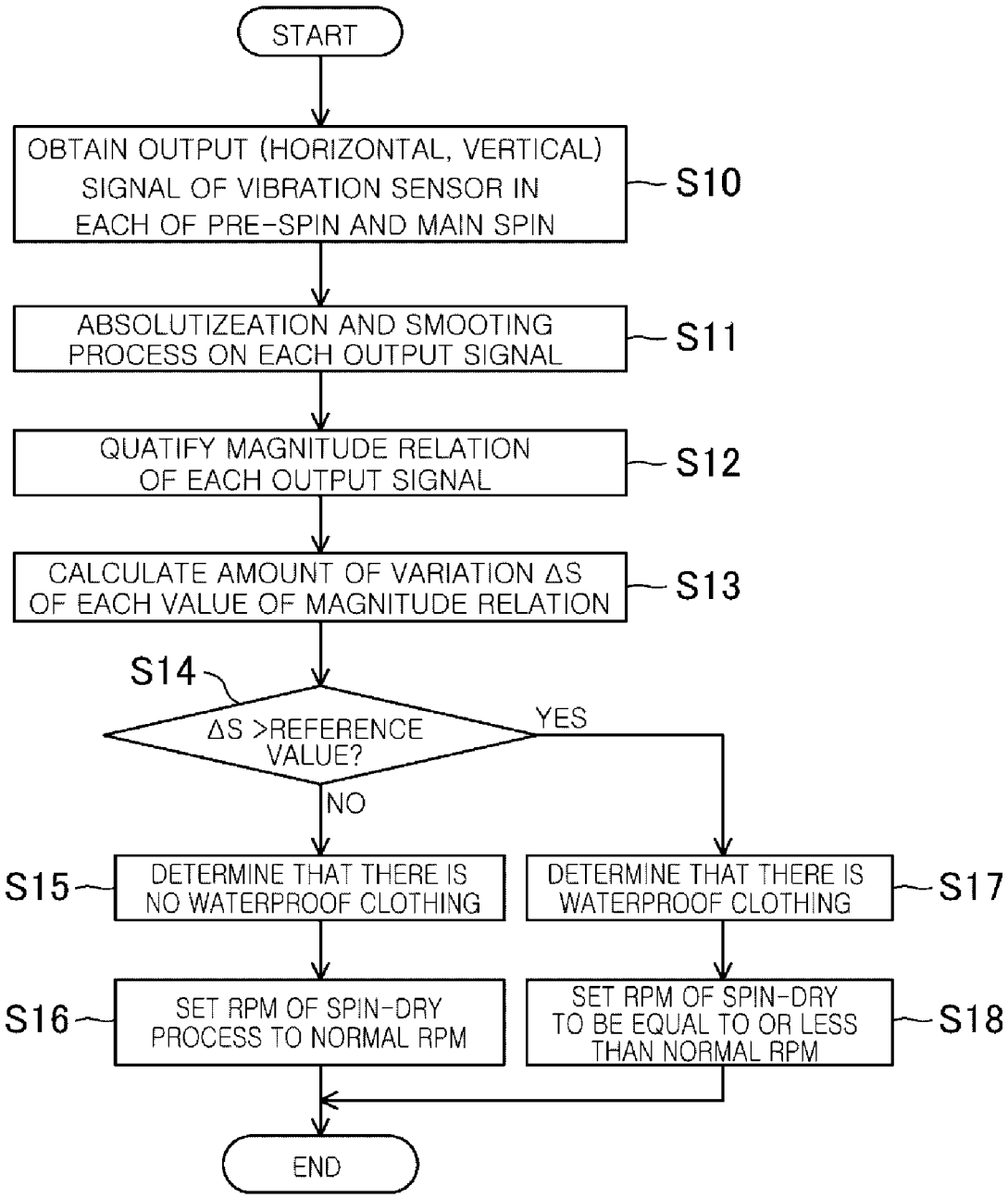
FIG. 6 is a flowchart illustrating a determination process with a first waterproof clothing determiner.

In this washing machine, to accurately detect such changes, the processor 60 has the first waterproof clothing determiner 64 installed to determine whether the waterproof clothing is present in the laundry C based on a detection value of the vibration sensor 19. It is also configured to set a spin-dry rpm based on the determination result. The determination process with the first waterproof clothing determiner 64 will now be described in detail with reference to a flowchart of FIG. 6.

Figure 7:
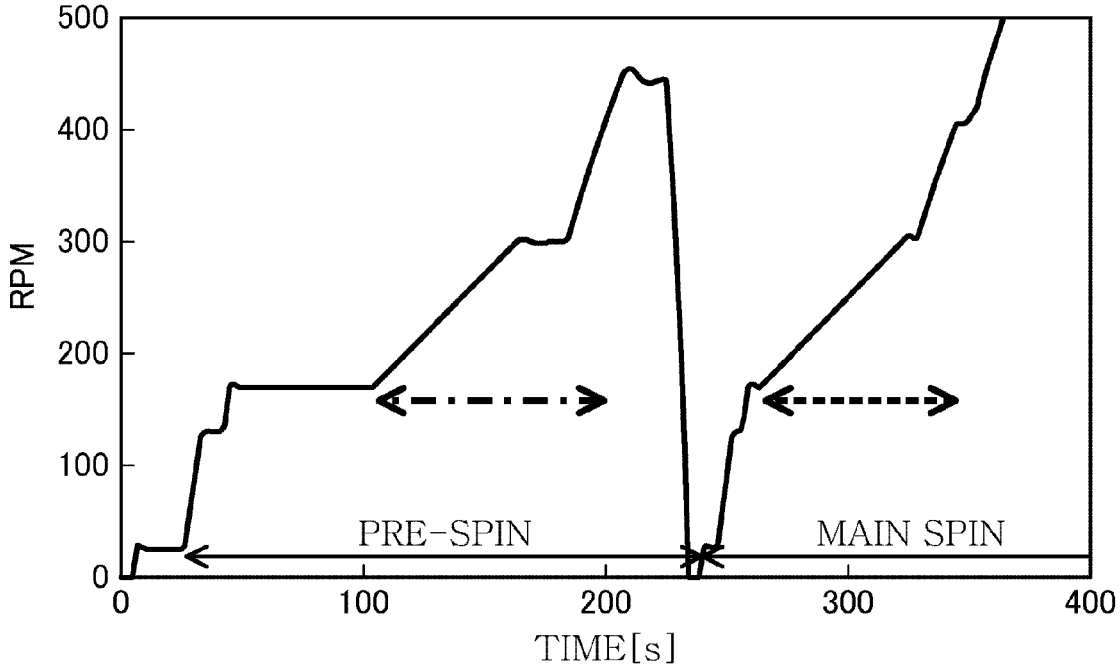
FIG. 7 is a graph for explaining two acceleration processes at the beginning of a spin-dry process.

In the beginning of the spin-dry process, the rotation controller 61 controls two acceleration processes to be performed to accelerate rotation of the spin tub 20 in the low-speed rotation region. Specifically, as shown in FIG. 7, in the beginning of the spin-dry process, the rotation controller 61 performs rotation control to accelerate rotation to a preset low rpm before occurrence of abnormal vibration and decelerate the rotation (pre-spin), before controlling the rotation of the spin tub 20 as in the common spin-dry process during which rotation is accelerated to a spin-dry rpm (main-spin).

Further, in the respective acceleration processes of the main spin and the pre-spin, for the same rpm zone in which acceleration conditions are the same (represented in alternate long and short dash lines or broken lines), detection values detected by the vibration sensor 19 (detection values in two directions: horizontal and vertical directions) are obtained by the first waterproof clothing determiner 64, in step S10.

Figure 8:
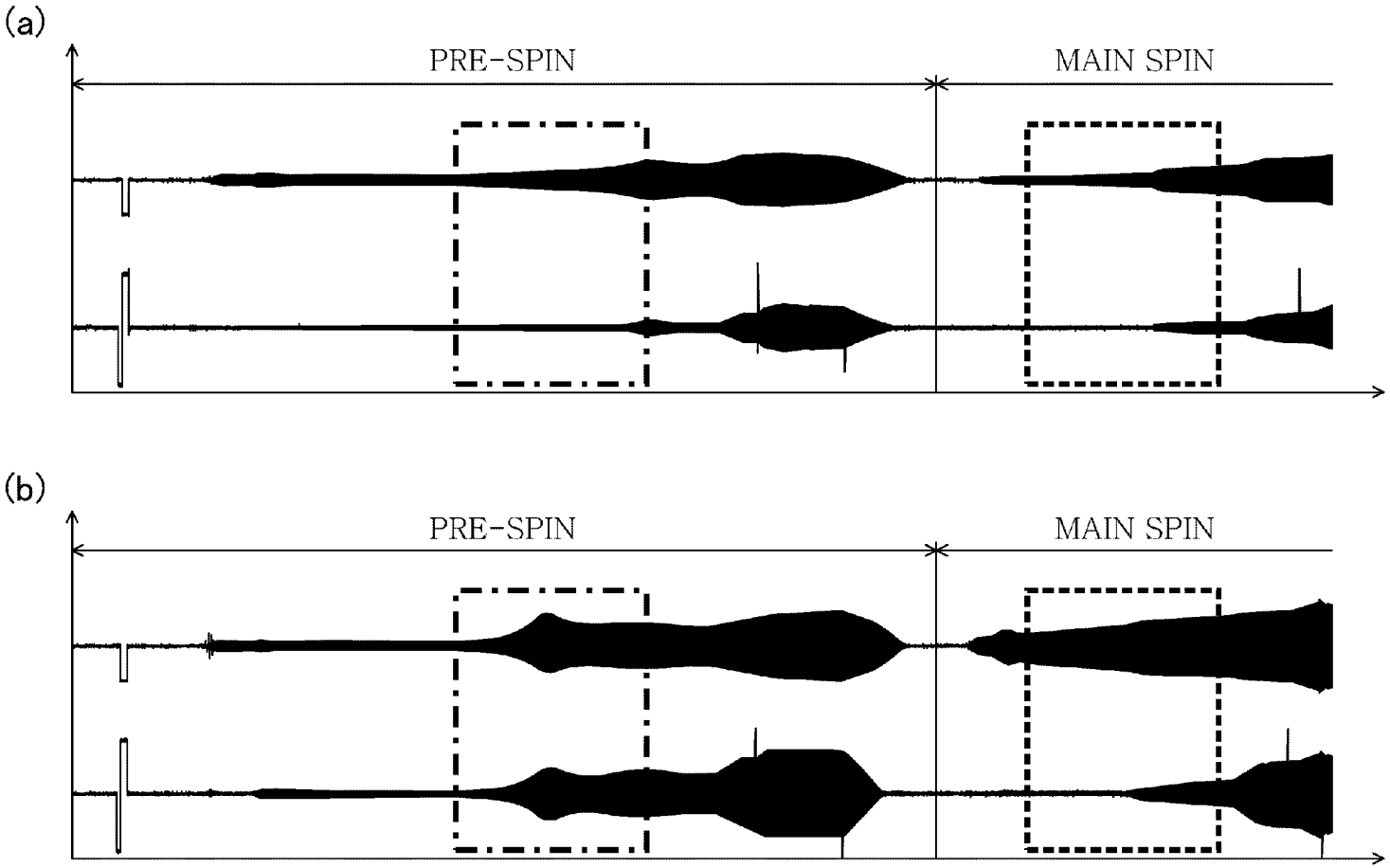
FIG. 8 shows an example of horizontal and vertical angle detection values of a vibration sensor in each of a main spin and a pre-spin, where (a) shows a case where there is normal clothing only, and (b) shows a case where waterproof clothing is mixed therein.

In (a) and (b) of FIG. 8, an example of the respective horizontal and vertical detection values (output signals of acceleration representing the magnitude of vibration) of the vibration sensor 19 is shown. (a) of FIG. 8 shows an occasion when there is only normal clothing Cn and (b) of FIG. 8 shows an occasion when the waterproof clothing Cwp is mixed up. The horizontal axes represent time and the vertical axes represent detection values. The section indicated by alternate long and short dash lines represents an rpm zone in which detection values are sampled to be used for comparison operation.

When the laundry C includes only the normal clothing Cn, its weight is reduced, and the amount of imbalance is somewhat changed accordingly, but the imbalance position remains almost unchanged in the second acceleration process as compared toith the first acceleration process. Hence, when the respective detection values of the vibration sensor 19 in the main spin and the pre-spin are compared, their absolute values (amplitudes) have no big change for the pre-spin and the main spin. Relative changes in difference of each horizontal and vertical detection values in the main spin and the pre-spin are "small" (because the imbalance position is almost unchanged).

On the contrary, on an occasion when the waterproof clothing Cwp is mixed into the laundry C and the water-saturated condition occurs, the relative changes in difference of each horizontal and vertical detection values in the main spin and the pre-spin are "large".

Figure 9:
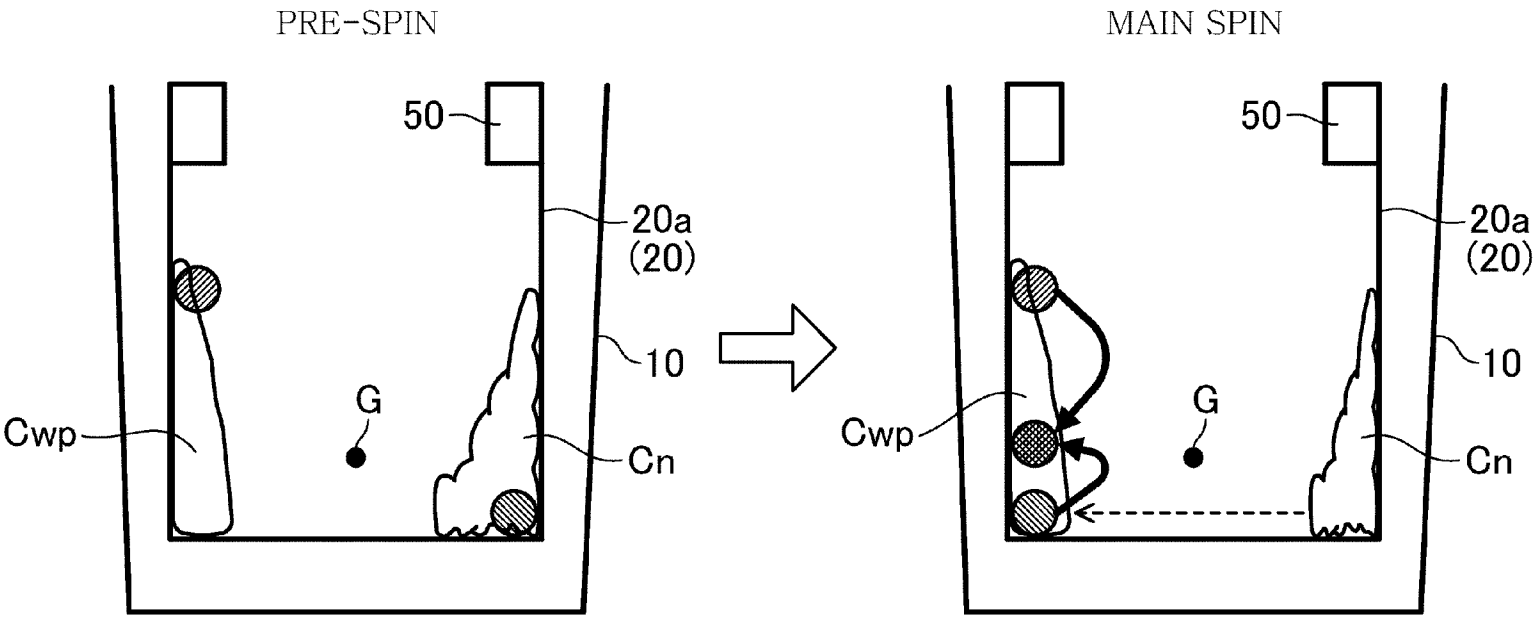
FIG. 9 shows a view for explaining a vibration type on an occasion when waterproof clothing is mixed into the laundry and a water-saturated condition occurs.

Specifically, as shown in FIG. 9, in the pre-spin, the weight of the waterproof clothing Cwp is almost unchanged; the water inside moves upward and sticks to the circumferential wall 20*a* by action of the centrifugal force; and the normal clothing Cn reduces its weight and sticks to the circumferential wall 20*a* to be somewhat lopsided to the lower portion of the spin tub (the imbalance position becomes close to the center). As a result, in the spin tub 20, the imbalance position of the waterproof clothing Cwp and the imbalance position of the normal clothing Cn are opposite as in pattern (e), making big shake, and thus, the absolute value of the detection value (magnitude of the vibration) becomes large in any of the horizontal and vertical directions.

On the other hand, in the main spin, the waterproof clothing Cwp goes into the similar condition to that of the pre-spin, while the weight of the normal clothing Cn is reduced with the pre-spin, making the amount of imbalance small and the imbalance position moves near to the center on the side of the waterproof clothing Cwp. As a result, the imbalance position above the center and the imbalance position below the center are aligned toward the waterproof clothing Cwp, and an imbalance position combined is almost the same as the center or at the height around the center as in the pattern (c).

This makes the absolute value (magnitude) of the detection value in the horizontal direction become larger than in the vertical direction, and the relative changes in difference of each horizontal and vertical detection values in each of the main spin and the pre-spin become "large". As described above, there is a difference in vibration type in each of the main spin and the pre-spin between an occasion when there is only normal clothing Cn and an occasion when the waterproof clothing Cwp is mixed into the laundry C and the water-saturated condition occurs, so whether the waterproof clothing Cwp is present may be determined by comparing the differences.

Using the detection values in a plurality of directions facilitates detection of changes in amount and position of imbalance, which makes it possible to increase the detection accuracy.

Figure 10:
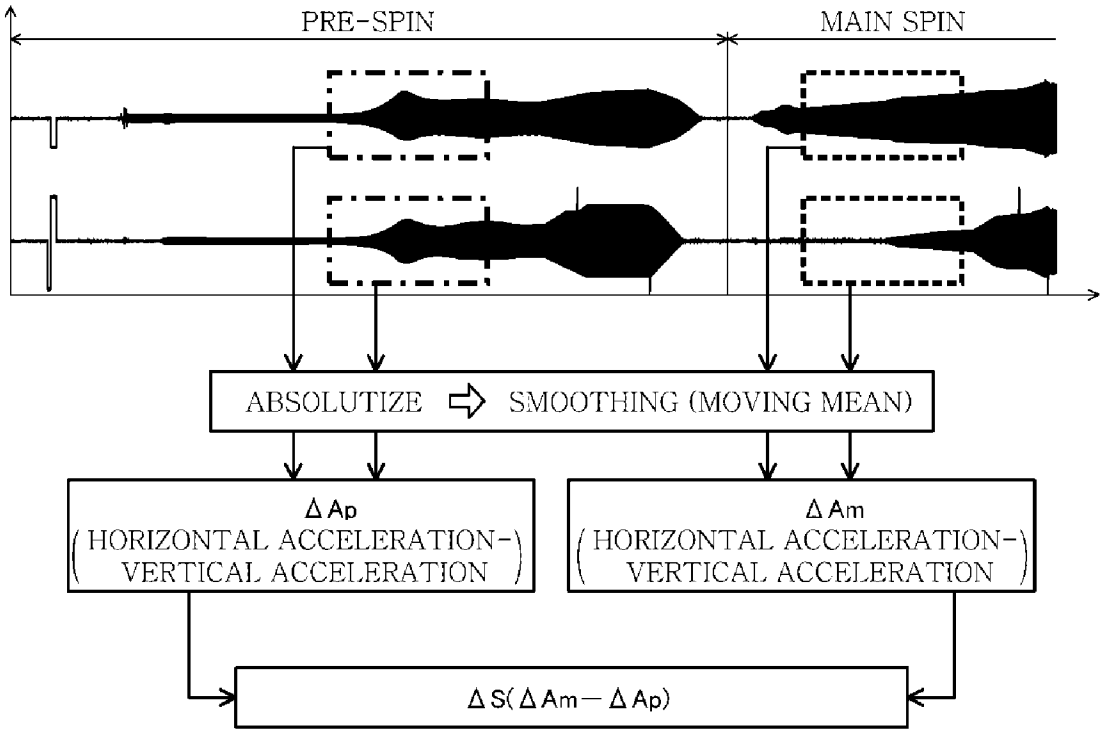
FIG. 10 shows a view for describing comparison operation with a first waterproof clothing determiner.

When the first waterproof clothing determiner 64 obtains detection values in two directions, horizontal and vertical directions, in each acceleration process, and as shown in FIG. 10, processes such as absolutization and smoothing are performed on each detection value obtained to convert the detection value (output signal) to a comparable value. In other words, because the output signal has periodic positive and negative values, it is absolutized and smoothed by calculating a moving average of each signal, in step S11.

The values obtained as described above, subtraction is performed on the horizontal and vertical values in each of the pre-spin and the main spin (horizontal acceleration—vertical acceleration), and magnitude relations of output signals between horizontal and vertical directions are quantified in each of the pre-spin and the main spin. With this, two magnitude relation values ΔAp, ΔAm are calculated in every acceleration process of the pre-spin and main spin, in step S12.

Subtraction of the two magnitude relation values ΔAp, ΔAm is performed (ΔAm-ΔAp), to calculate an amount of change of the magnitude relation values ΔS, in step S13.

A reference value is preset in the first waterproof clothing determiner 64, to be compared with the amount of change of the magnitude relation values, ΔS, thereby enabling determination of whether the waterproof clothing Cwp is present. The reference value is obtained by experiment or something, and appropriately changed based on the machine type or size, operation mode, etc.

Once the amount of change of the magnitude relation values ΔS is calculated, the first waterproof clothing determiner 64 checks whether the amount of change ΔS is greater than the reference value, in step S14. When the result of determination is "no", it is determined that no waterproof clothing Cwp is present in step S15, and maintains the setting of the spin-dry rpm of the spin tub 20 to be a normal rpm (e.g., 1,000 rpm) in the main spin, in step S16.

On the other hand, when the result of determination is "yes", it is determined that waterproof clothing Cwp is present in step S17, and changes the setting of the spin-dry rpm of the spin tub 20 to be a preset low velocity (e.g., 300 rpm) in the main spin, in step S18.

This may prevent abnormal vibration that might otherwise occur in the spin-dry process due to the waterproof clothing Cwp and complete the spin-dry process without stopping operation of the washing machine.

Furthermore, when it is determined that the waterproof clothing Cwp is present, the notification buzzer 6 may sound an alarm, or a display panel of the operator 2 or the terminal 80 may display an error message, to notify the user to call his/her attention.

Moreover, in the case that it is determined that the waterproof clothing Cwp is present, the operation may be stopped at the right step and prompt the user to have a check and resume the operation.

Second Determination Apparatus for Determining Whether Waterproof Clothing Cwp is Present)

Figure 11:
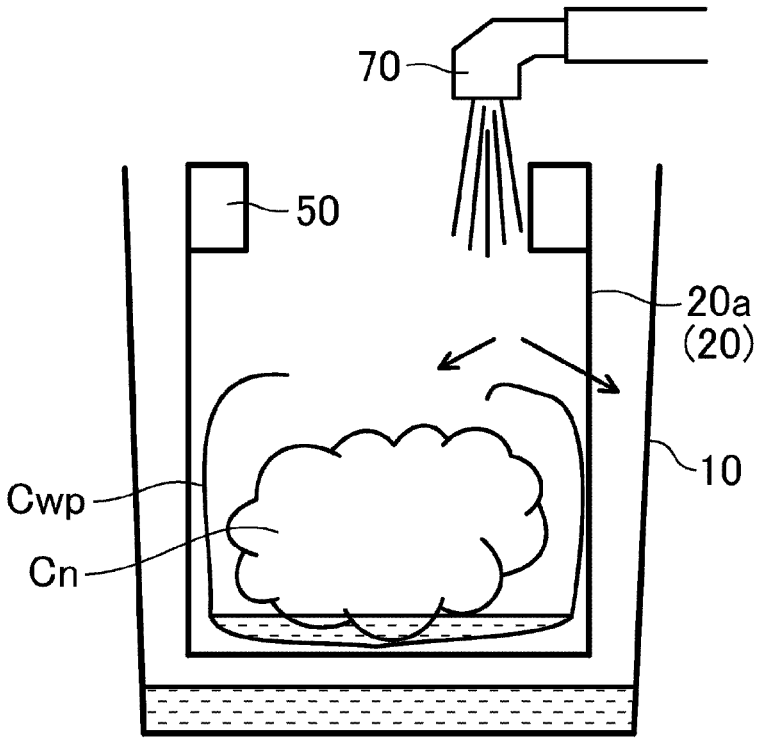
FIG. 11 is a schematic cross-sectional view representing a water level before an inflection point of water level in a water supply process.

When the waterproof clothing Cwp is mixed into the laundry C, as shown in FIG. 11, the inside of the spin tub 20 is partitioned with the waterproof clothing Cwp spreading like a bag, and some space in the lower portion of the spin tub 20 may sometimes be occupied by the waterproof clothing Cwp (volume reduction condition).

The washing machine is configured to determine from the volume reduction condition whether the waterproof clothing Cwp is present. Specifically, the waterproof clothing pre-determiner 65 is installed in the processor 60 to determine whether the waterproof clothing Cwp is present based on water level variance rate during water supply in each washing or rinsing process.

As shown in FIG. 11, when water drops from the water supply device 70 into the spin tub 20 during water supply, the water is stored in the water tub 10 to a set water level, in which case, however, if the volume reduction condition occurs, the water is also stored inside the waterproof clothing Cwp.

Figure 12:
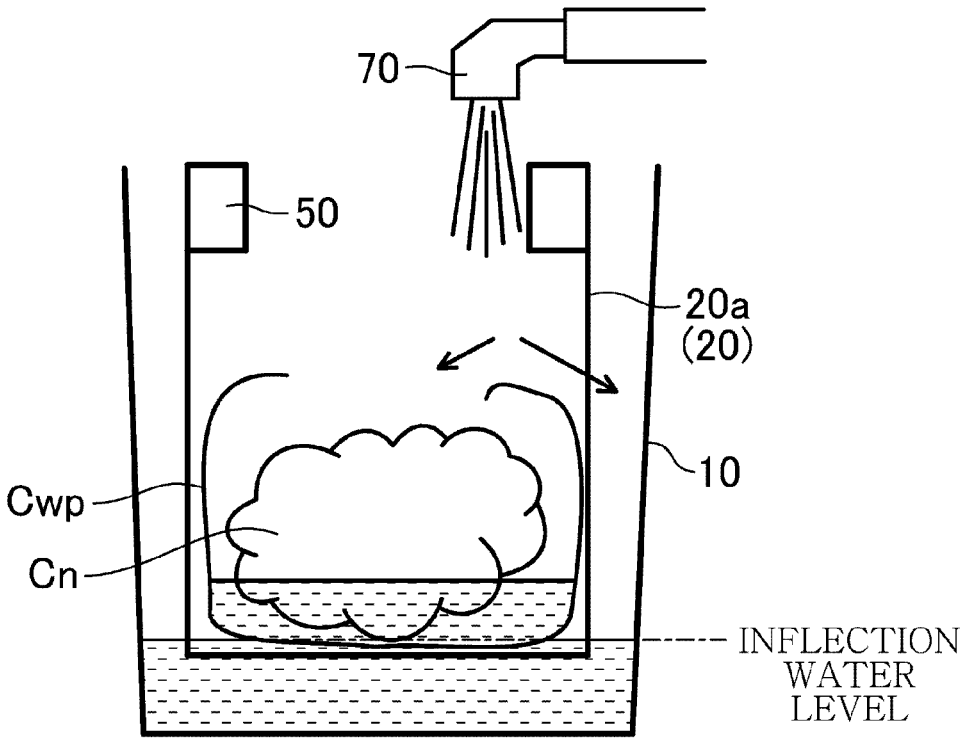
FIG. 12 is a schematic cross-sectional view representing a water level at an inflection point of water level in a water supply process.

When the water is stored in the water tub 10 and as shown in FIG. 12, the water level reaches the border with the lower end of the waterproof clothing Cwp, the capacity of the water tub 10 is reduced as much as the volume occupied by the waterproof clothing Cwp, so the water level detected by the water level sensor 18 rapidly rises. In other words, when the waterproof clothing Cwp is mixed into the laundry C, there is an inflection point in the water level where the water level variance rate (the rate at which the water level per unit time is changed) abruptly increases (and a water level at the point is called an inflection water level).

Accordingly, whether there is waterproof clothing may be determined by comparing water level variance rates with the border of the inflection water level. In general, the inflection water level is located at a height near the upper surface of the bottom wall of the spin tub 20.

Figure 13:
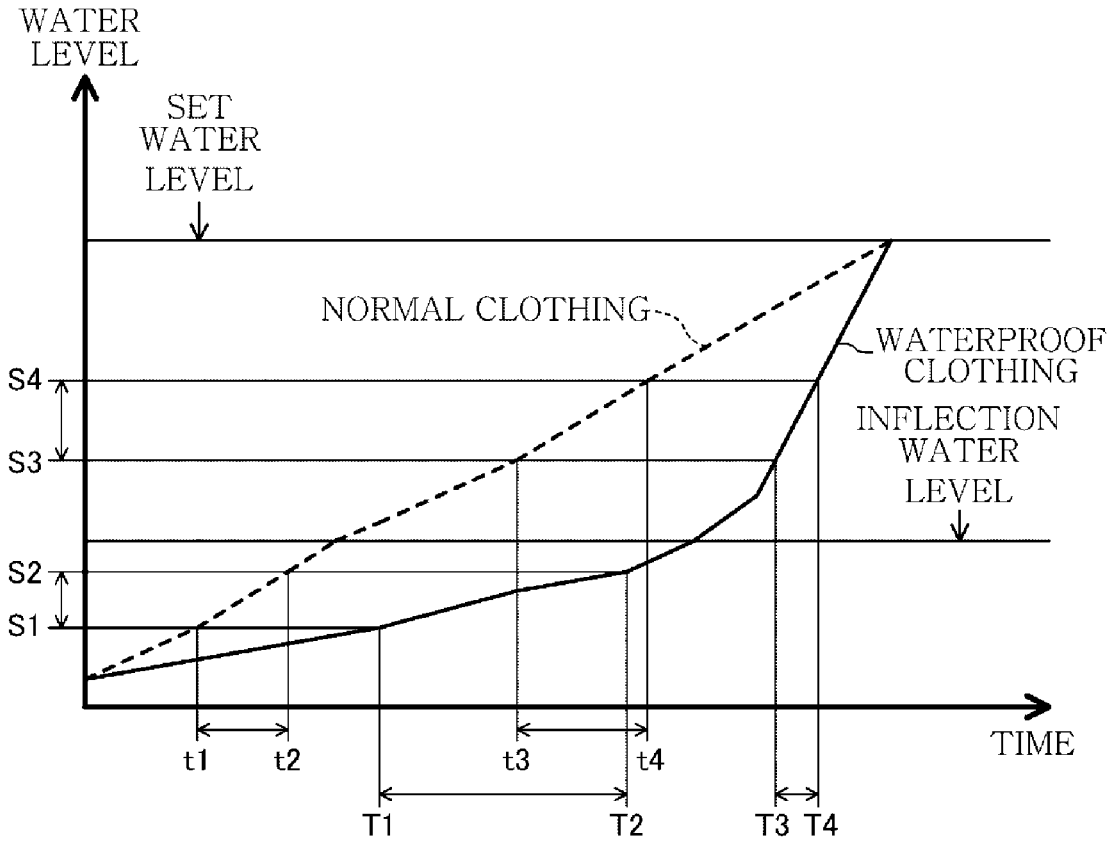
FIG. 13 is a graph representing water level variance rate of normal clothing and water level variance rate of waterproof clothing.

As shown in broken lines of FIG. 13, when the laundry C is only comprised of the normal clothing Cn, water fully is collected up from the bottom of the water tub 10, so the water level rises at almost constant rate until reaching to a preset water level after water supply begins.

For example, for the normal clothing Cn, before the inflection water level, a first water level variance rate Δ1 may be calculated based on point t1 at which water level S1 is reached from the start of the water supply and point t2 at which water level S2 is reached. That is, Δ1=(S2−S1)/(t2−t1).

Furthermore, after the inflection water level, a second water level variance rate Δ2 may be calculated based on point t3 at which water level S3 is reached from the start of the water supply and point t4 at which water level S4 is reached. That is, Δ2=(S4−S3)/(t4−t3).

In the case that there is only the normal clothing Cn, the water level variance rate is almost constant until a set water level is reached from the start of the water supply, so a ratio of the second water level variance rate Δ2 to the first water level variance rate Δ1 becomes almost '1'. Hence, by comparison with a certain threshold (e.g., 3~6), it may be determined that there is no waterproof clothing Cwp.

On the other hand, when the waterproof clothing Cwp is mixed in, the water level variance rate is significantly changed at the inflection water level. Because of this, the first water level variance rate Δ1 before the inflection water level, i.e., Δ1=(S2−S1)/(T2−T1) is noticeably small as compared with the second water level variance rate Δ2 after the inflection water level, i.e., Δ2=(S4−S3)/(T4−T3).

Accordingly, the ratio of the second water level variance rate Δ2 to the first water level variance rate Δ1 is, for example, about 10, which is then compared with a certain threshold (e.g., 3~6), so it may be determined that there is the waterproof clothing Cwp.

In the case that the waterproof clothing pre-determiner 65 determines that there is the waterproof clothing Cwp, the processor 60 controls the driving motor 30 to rotate the spin tub 20 at lower rpm than usual for the spin-dry process.

Specifically, in a normal spin-dry process, the spin tub 20 maintains its spin-dry rotation at more than 1,000 rpm, but in the case that it is determined that there is the waterproof clothing Cwp, the rpm is changed to e.g., about 300 rpm.

This may prevent abnormal vibration that might otherwise be caused in the spin-dry process due to the waterproof clothing Cwp and complete the spin-dry process without stopping operation of the washing machine.

Furthermore, when it is determined that the waterproof clothing Cwp is present, the notification buzzer 6 may sound an alarm, or a display panel of the operator 2 or the terminal 80 may display an error message, to call attention to the user.

Figure 14:
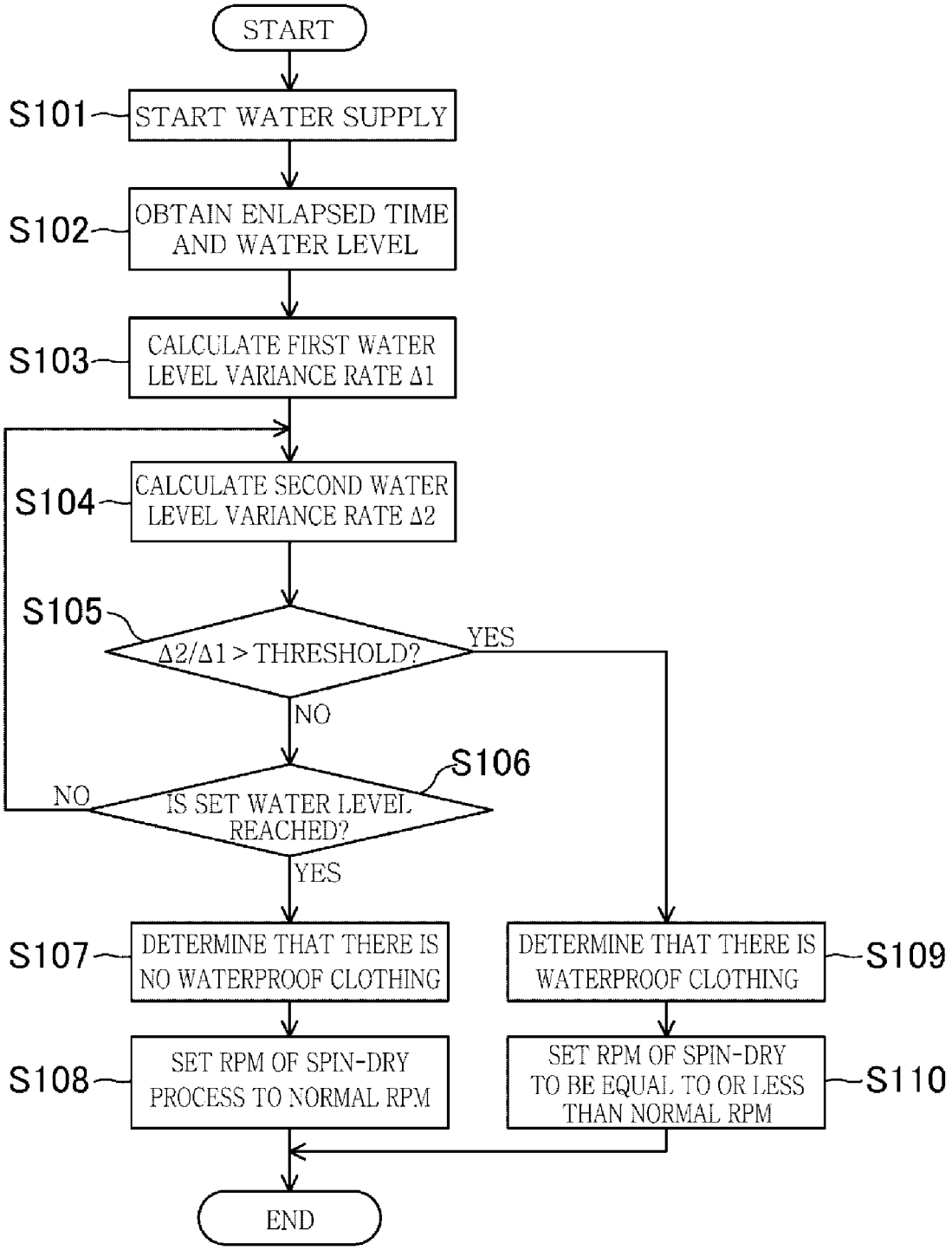
FIG. 14 is a flowchart illustrating a determination process with a waterproof clothing pre-determiner.

The determination process with the waterproof clothing pre-determiner 65 will now be described in detail with reference to a flowchart of FIG. 14.

In the beginning of each washing or rinsing process, when water starts to be supplied from the water supply device 70 in step S101, time t elapsed from the start of water supply and water level S in the water tub 10 at the elapsed time t are obtained in step S102. The elapsed time t and the water level S are obtained one by one during the time from the start of water supply until a set water level is reached.

Based on the point t1 at which the water level S1 before the inflection water level is reached from the start of the water supply and the point t2 at which the water level S2 is reached, the first water level variance rate Δ1 is calculated, in step S103. Continuously, based on the point t3 at which the water level S3 is reached after the inflection water level higher than the water level S2 and the point t4 at which the water level S4 is reached, the second water level variance rate Δ2 is calculated, in step S104.

Furthermore, it is determined whether the ratio Δ2/Δ1 of the second water level variance rate Δ2 to the first water level variance rate Δ1 is greater than a certain threshold, in step S105. When the result of determination is "yes", it is determined that the waterproof clothing Cwp is present in step S109, and the setting of the spin-dry rpm of the spin tub 20 is changed to be a preset low velocity (e.g., 300 rpm) in the spin-dry process, in step S110.

On the other hand, when the result of determination is "no" in step S105, whether the water level in the water tub 10 reaches a set water level is checked in step S106, and when the water level in the water tub 10 does not reach the set water level, the flow goes back to the step S104 where the second water level variance rate Δ2 is calculated again. In the recalculation, the water levels S3 and S4 are updated to be higher than before, and the second water level variance rate Δ1 is calculated.

When the water level in the water tub 10 reaches the set water level, there has been no occasion when Δ2/Δ1 is greater than the preset threshold during the time from the start of the water supply until the set water level is reached, so it is determined that there is no waterproof clothing Cwp in step S107, and the setting of the spin-dry rpm of the spin tub 20 is kept at normal rpm, e.g., 1,000 rpm, in step S108.

Furthermore, when it is determined that there is the waterproof clothing Cwp, in the washing process or rinsing process performed after water is supplied, it is possible to increase the rpm of the pulsator 40 to the normal rpm or higher. In this case, the waterproof clothing Cwp is further untangled, which suppresses the occurrence of the water-saturated condition, so the abnormal vibration during the spin-dry process may hardly occur.

As described above, the washing machine of the disclosure includes two apparatuses for determining the waterproof clothing Cwp based on different mechanisms, thereby preventing abnormal vibration more effectively.

(Apparatus for Predicting Abnormal Vibration)

The washing machine further includes the sign detector 66 for detecting a sign of abnormal vibration before occurrence of the abnormal vibration in the spin-dry process to force rotation of the spin tub 20 to an emergency stop. As shown in FIG. 3, the sign detector 66 is also comprised of two detectors based on different mechanisms: a rhythm detector 66*a* and a variance rate detector 66*b*.

The rhythm detector 66*a* is based on the fact that the inventors of the disclosure have found that a unique behavior appears in a rhythm component having a longer period than the rotation period of the spin tub 20, which is extracted from a signal of the vibration sensor 19 output before occurrence of abnormal vibration, and the variance rate detector 66*b* is based on the fact that the inventors of the disclosure have found that the amplitude of vibration of the spin tub 20 abruptly changes before occurrence of abnormal vibration.

Figure 15:
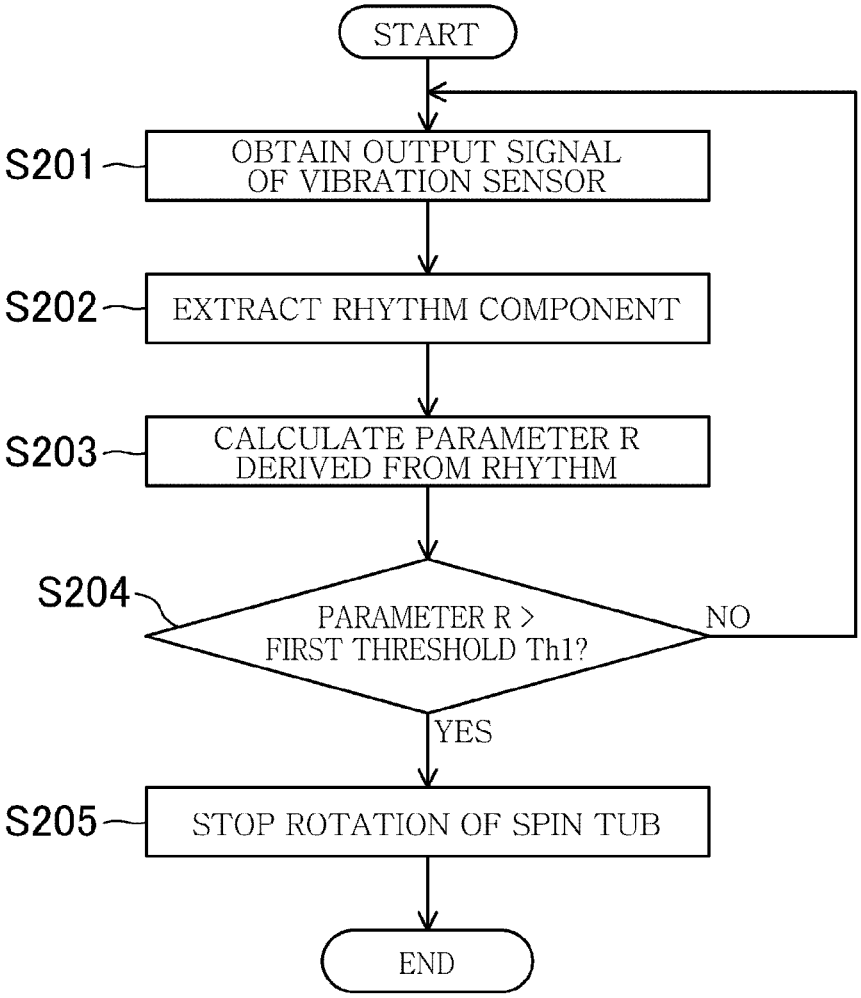
FIG. 15 is a flowchart of detecting a sign of abnormal vibration with a rhythm detector.
Figure 16:
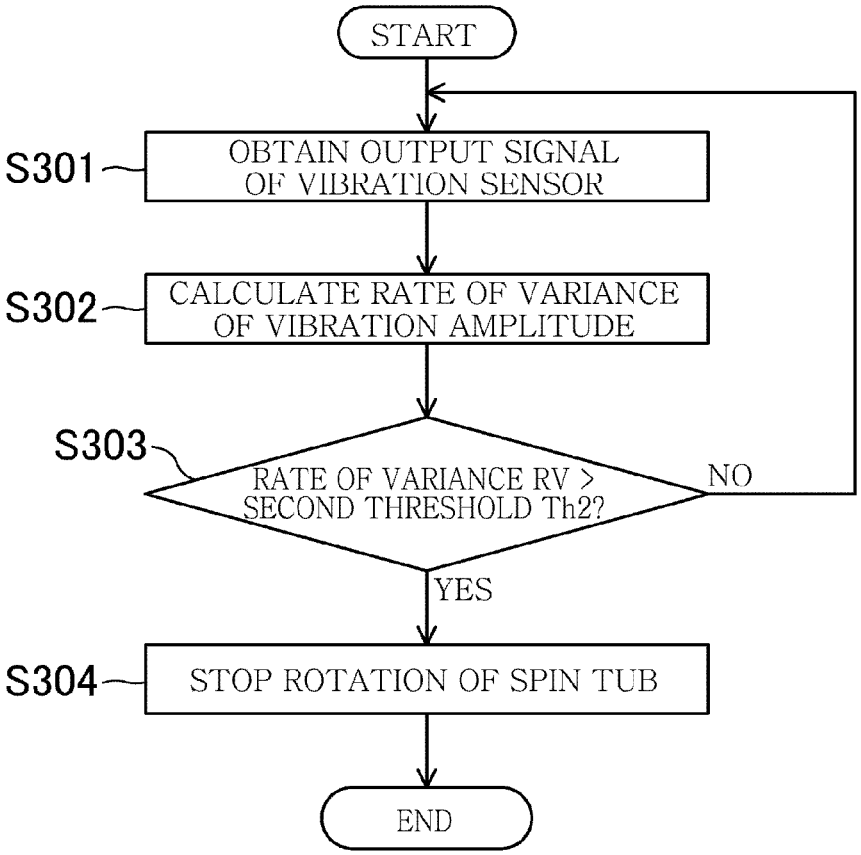
FIG. 16 is a flowchart of detecting a sign of abnormal vibration with a variance rate detector.

A process of sign detection of abnormal vibration performed by the rhythm detector 66*a* and the variance rate detector 66*b* based on a rhythm and a variance rate of vibration amplitude will now be described in detail with reference to FIGS. 15 and 16. FIG. 15 is a flowchart of sign detection of abnormal vibration based on a rhythm component, and FIG. 16 is a flowchart of sign detection of abnormal vibration based on vibration amplitude.

As shown in FIG. 15, sign detection of abnormal vibration based on rhythm components is performed by the rhythm detector 66*a*, and during the spin-dry process, signals output from the vibration sensor 19 are continuously obtained by the rhythm detector 66*a*, in step S201. The rhythm detector 66*a* performs certain signal processing on the output signal obtained, to extract a rhythm component having a longer period than the rotation period of the spin tub 20, in step S202.

In this case, it is desirable to change the extracted rhythm component based on the rpm of the spin tub 20. Specifically, as a result of simulating abnormal vibration occurring in an imbalanced state of the spin tub 20 by spreading a vinyl bag in the spin tub 20, the highest frequency (peak frequency) of the rhythm components detected before occurrence of abnormal vibration tends to increase as the rpm of the spin tub 20 increases. In other words, there is a primary correlation between the rpm of the spin tub 20 and the peak frequency of the rhythm component detected right before occurrence of abnormal vibration, so the detection accuracy may be improved by changing the rhythm component to be extracted based on the correlation.

The rhythm detector 66*a* decomposes the extracted rhythm components, e.g., vibration components obtained by the vibration sensor 19, through e.g., a fast Fourier transform (FFT), and calculates a certain parameter R derived from the rhythm e.g., by calculating strength of a certain frequency of vibration component, in step S203.

The rhythm detector 66*a* checks whether the parameter R has a value greater than a preset first threshold Th1, in step S204. When the result is "no", it is determined that there is no sign of abnormal vibration and the process goes back to the step S201. When the result is "yes", it is determined that there is a sign of abnormal vibration and the rotation of the spin tub 20 is forced to an emergency stop, in step S205.

As shown in FIG. 16, sign detection of abnormal vibration based on a rate of variance of vibration amplitude is performed by the variance rate detector 66*b*, and during the spin-dry process, signals output from the vibration sensor 19 are continuously obtained by the variance rate detector 66*b*, in step S301.

The variance rate detector 66*b* performs certain signal processing on the output signal obtained to calculate a rate of variance (RV) of vibration amplitude of the water tub 10, in step S302, and checks whether the rate of variance (RV) of vibration amplitude is greater than a preset second threshold Th2, in step S303.

When the result is "no", it is determined that there is no sign of abnormal vibration and the process goes back to the step S301. When the result is "yes", it is determined that there is a sign of abnormal vibration and the rotation of the spin tub 20 is forced to an emergency stop, in step S304.

Along with the emergency stop of the rotation of the spin tub 20, the notification buzzer 6 may sound an alarm, or a display panel of the operator 2 or the terminal 80 may display an error message, to call attention to the user.

Furthermore, when the user takes the waterproof clothing Cwp out of the spin tub 20 and resumes the process, opening and closing of the lid 1*b* on this occasion is detected by the open/close sensor 8. Hence, the operation is resumed from the spin-dry process by user manipulation of the resume switch 7. The rotation controller 61 resets the setting of rpm to an initial state for the spin tub 20 to rotates at the normal spin-dry rpm when the user manipulates the resume switch 7 after opening and closing the lid 1*b* after the emergency stop.

<Application of Washing Machine>

An application of a washing machine designed to get rid of water gathered around the waterproof clothing Cwp when it is determined that there is the waterproof clothing Cwp will be described.

Figure 17:
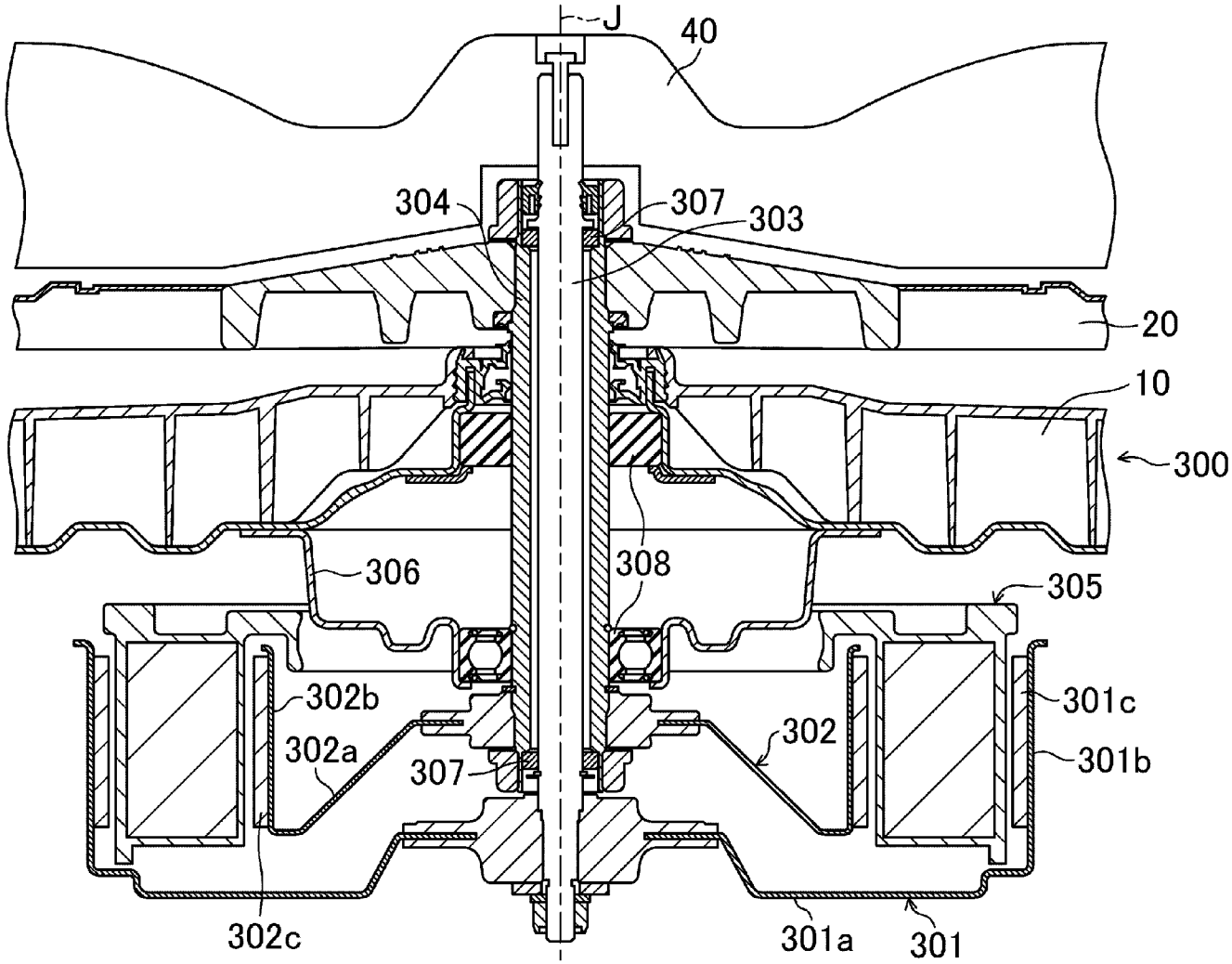
FIG. 17 is a side cross-sectional view illustrating a structure of a driving motor equipped in a washing machine in an exemplary application.

FIG. 17 shows an example of a driving motor equipped in a washing machine in this application. The driving motor 300 includes an outer rotor 301 (second rotor), an inner rotor 302 (first rotor), an inner shaft 303 (first rotation shaft), an outer shaft 304 (second rotation shaft), a ring type stator 305, etc. Specifically, the driving motor 300 is a so-called dual-rotor motor including the outer rotor 301 and the inner rotor 302 located on outer side and inner side of the single stator 305, respectively, in the radial direction.

The outer rotor 301 and the inner rotor 302 are coupled to the pulsator 40 or the spin tub 20 without intervention of a clutch or accelerator or decelerator, to directly drive them.

The outer rotor 301 and the inner rotor 302 share a coil of the stator 305, and the driving motor 300 is configured to drive rotation of the outer rotor 301 and the inner rotor 302 separately by applying an electric current to the coil. The stator 305 is attached to a bearing bracket 306 mounted on the bottom surface of the water tub 10.

The outer rotor 301 is a cylindrical member having a flat bottom, and includes a bottom wall 301*a* whose center portion is open, a rotor yoke 301*b* installed to stand around the bottom wall 301*a*, and a plurality of outer magnets 301*c* formed of arc-shaped permanent magnets.

The inner rotor 302 is a cylindrical member having a flat bottom with the external diameter smaller than the outer rotor 301, and includes a bottom wall 302*a* whose center portion is open, an inner circumferential wall 302*b* installed to stand around the bottom wall 302*a*, and a plurality of inner magnets 302*c* formed of permanent magnets shaped like rectangular plates.

The inner shaft 303 is a circular shaft member, and is supported by upper and lower inner bearings 307 to be freely rotated inside the outer shaft 304. The lower end of the inner shaft 303 is coupled to the outer rotor 301. The upper end of the inner shaft 303 is coupled to the pulsator 40.

The outer shaft 304 is a cylindrical shaft member shorter than the inner shaft 303 and having inner diameter greater than the outer diameter of the inner shaft 303, and is supported by the bearing bracket 306 through the upper and lower ball bearings 308 to be freely rotated. The lower end of the outer shaft 304 is coupled to the inner rotor 302. The upper end of the outer shaft 304 is coupled to the spin tub 20.

The stator 305 is formed of a ring type member with outer diameter smaller than the inner diameter of the outer rotor 301 and inner diameter greater than the outer diameter of the inner rotor 302. The stator 305 includes a plurality of teeth or coils equipped in the state of being buried in resin.

With the structure, the driving motor 300 may drive rotation of the spin tub 20 and the pulsator 40, separately. Hence, when it is determined that there is the waterproof clothing Cwp, the water gathered by the waterproof clothing Cwp may be removed.

For example, when it is determined that there is the waterproof clothing Cwp, in a state that draining is possible, the rotation controller controls the driving motor 300 to drive separate rotation of the pulsator 40 and the spin tub 20 (e.g., rotation in different directions or at different speed). Hence, forces from different directions may be acted on the waterproof clothing Cwp, to get rid of the water gathered around the waterproof clothing Cwp from the waterproof clothing Cwp.

In the case of this washing machine, a plurality of paddles or protrusions extending in the vertical direction may be formed on the inner surface of the circumferential wall 20*a* of the spin tub 20. This may facilitate even more effective removal of water gathered around the waterproof clothing Cwp.

However, the washing machine is not limited to what is described above in the first embodiment, and may include other various components. For example, directions in which to detect acceleration with the vibration sensor 19 may correspond to two directions, horizontal and vertical directions, but are not limited thereto. Although vibration conditions are compared in the acceleration process, it is also possible to compare vibration conditions in the deceleration process. It is also possible to use water level variance rate during a draining process instead of the water level variance rate during the water supply process.

Second Embodiment

A basic structure of the washing machine in the second embodiment is similar to the washing machine in the first embodiment. Hence, like reference symbols or numerals will be used for like elements, and the detailed description thereof will not be repeated. The washing machine of the second embodiment has software embedded in the processor, which is different from that in the first embodiment. Specifically, the washing machine in the second embodiment includes an apparatus for preventing abnormal vibration during the spin-dry (a third determination apparatus), which is different from that in the washing machine in the first embodiment.

Figure 18:
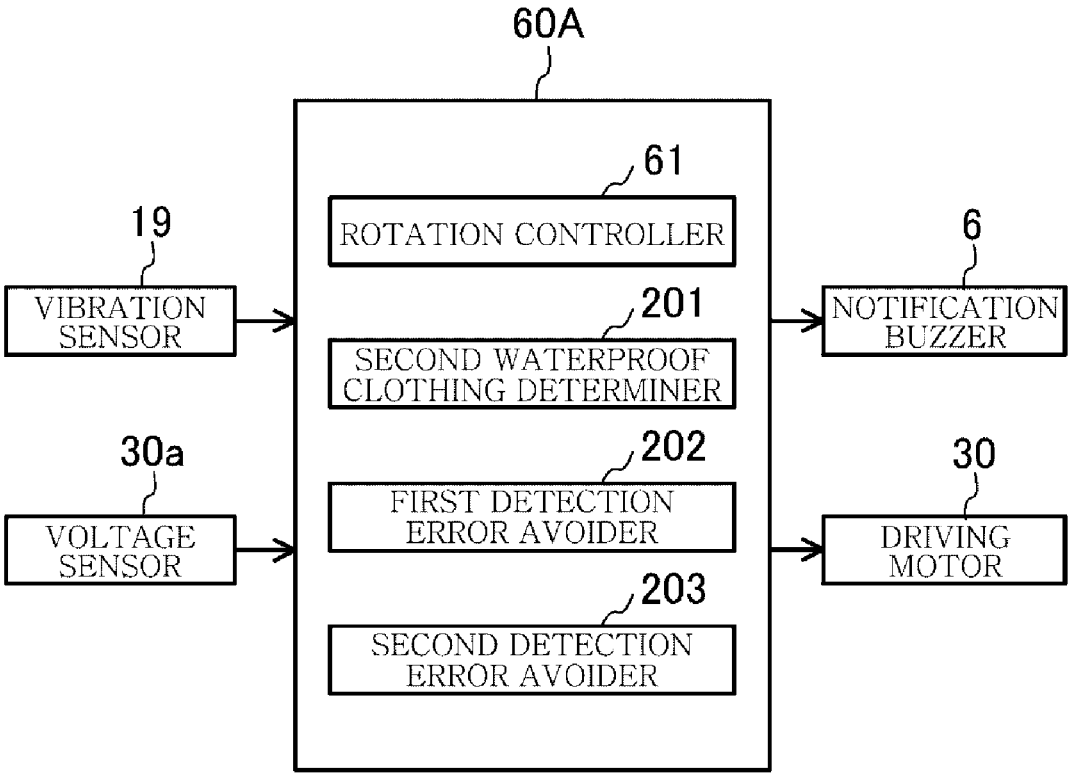
FIG. 18 is a block diagram illustrating major relationships between a processor and the respective components of a washing machine, according to a second embodiment of the disclosure.

FIG. 18 shows relationships between main configuration of a processor 60A and main components of the washing machine. The configuration specific to the second embodiment is simply shown in FIG. 18, but is not indented to exclude the components of the processor 60 of the first embodiment as shown in FIG. 3.

The processor 60A is coupled to the vibration sensor 19 and a voltage sensor 30*a* as input devices, and to the notification buzzer 6 and the driving motor 30 as output devices. The voltage sensor 30*a* is auxiliary mounted on the driving motor 30 to enter control voltage values for controlling the driving motor 30 to the processor 60A e.g., every 10 ms.

Furthermore, the processor 60A is equipped with the rotation controller 61, the second waterproof clothing determiner 201, a first detection error avoider 202, a second detection error avoider 203, etc. The rotation controller 61 controls operation of the driving motor 30 to control rotation of the spin tub 20 or the pulsator 40. The second waterproof clothing determiner 201 constitutes a third determination apparatus for determining whether there is the waterproof clothing Cwp based on the amount of shaking of rotation of the spin tub 20, and the first and second detection error avoiders 202 and 203 avoid detection error in the determination and improve accuracy in determination of the second waterproof clothing determiner 201.

(Third Determination Apparatus for Determining Whether there is Waterproof Clothing Cwp)

As shown in FIG. 11, when the waterproof clothing Cwp is mixed into the laundry C, the waterproof clothing Cwp may spread like a pouch and stick to the inner surface of the spin tub 20 (sticking condition), making the water collected inside the spin tub 20 and hardly drain out.

Figure 19:
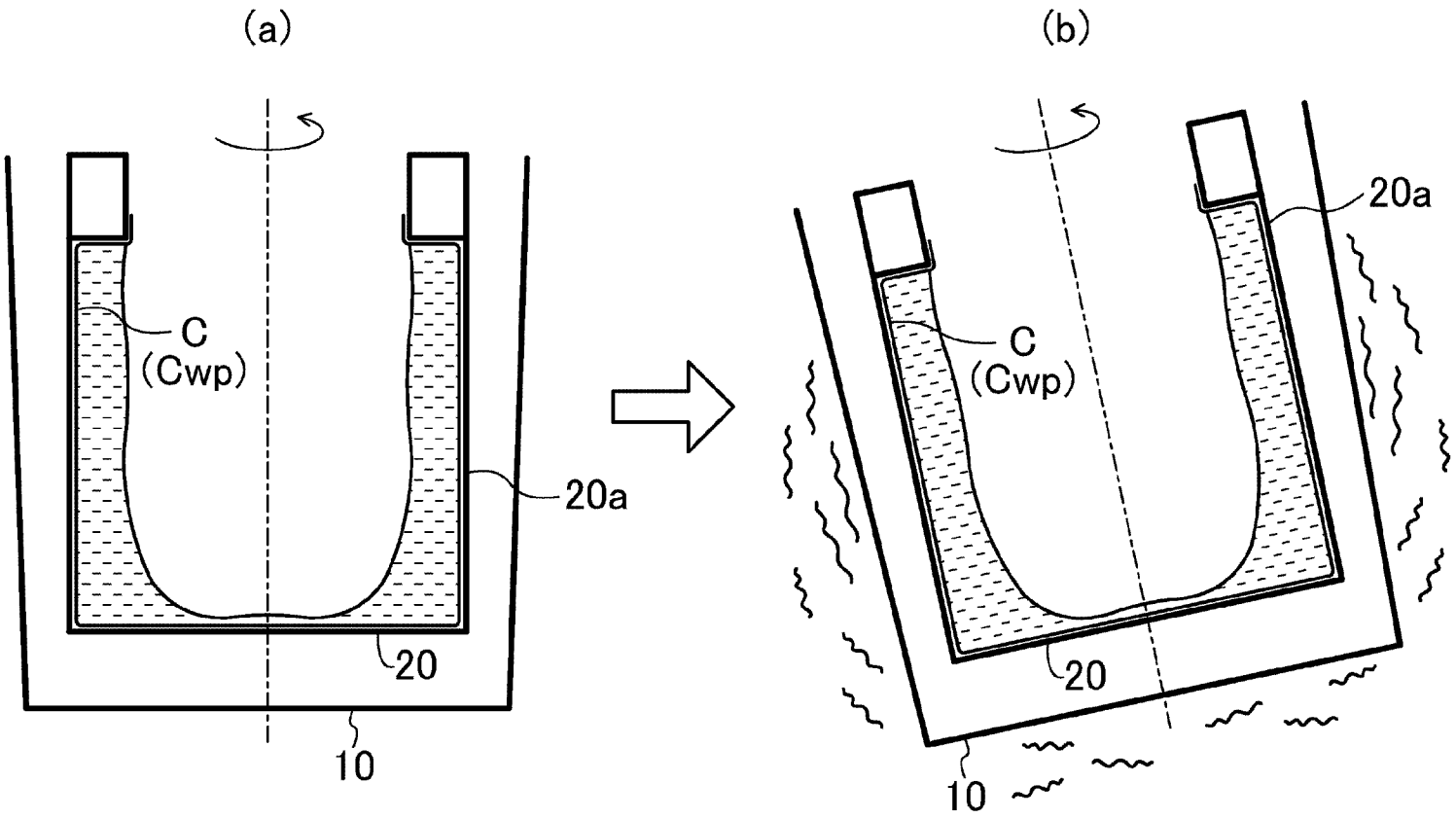
FIG. 19 is a view for explaining sticking states, where (a) shows a state before abnormal vibration occurs, and (b) shows a state when abnormal vibration occur.

In this sticking condition, when the rpm increases in the spin-dry, the water does not drain from the spin tub 20 but sticks to the circumferential wall 20*a* by the centrifugal force, as shown in (a) of FIG. 19. Further, when the rpm further increases, as shown in (b) of FIG. 19, the cycle in which the water fluctuates across the circumferential wall 20*a* is in sync with the vibration of the water tub, increasing the vibration for an instant, and thus causing abnormal vibration as if to break the washing machine.

The third determination apparatus is particularly suitable for determination of whether there is the waterproof clothing Cwp in the sticking condition. In this washing machine, to implement the third determination apparatus, the processor 60A has the second waterproof clothing determiner 201 installed to determine whether there is the waterproof clothing in the laundry C based on the rpm of the spin tub 20. It is also configured to set or give notification of a spin-dry rpm based on the determination result.

In this washing machine, similar to the first embodiment, in the beginning of the spin-dry process, the rotation controller 61 controls two acceleration processes to be performed to accelerate rotation of the spin tub 20 in the low-speed rotation region. Specifically, as shown in FIG. 20, the rotation controller 61 performs the pre-spin and the main spin in the beginning of the spin-dry process.

Figure 20:
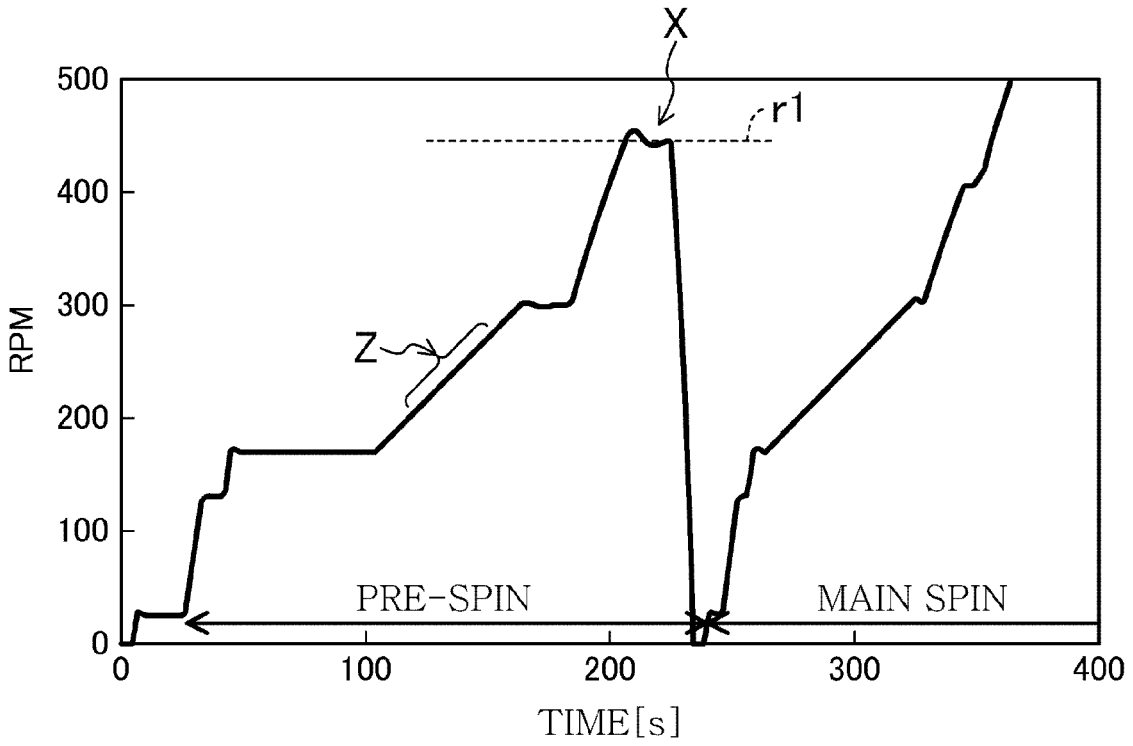
FIG. 20 is a graph representing rpm control of a spin tub in the beginning of a spin-dry process, according to the second embodiment of the disclosure.

In the pre-spin, the rotation controller 61 controls the driving motor 30 to accelerate rotation of the spin-tub 20 to a preset rpm (maintenance rpm indicated by r1 in FIG. 20), and maintain the rotation at the maintenance rpm r1 for e.g., tens of seconds (a rotation maintenance process indicated by arrow X in FIG. 20).

When there is normal clothing Cn only, as the rpm of the spin tub 20 increases, the weight of the normal clothing Cn decreases and the normal clothing Cn is a bit lopsided to the lower side of the spin tub 20 and gets to stick to the circumferential wall 20*a* (the imbalance position gets closer to the center). Accordingly, the spin tub 20 with only the normal clothing Cn has small "inertia", so the amount of shaking of rotation, i.e., an amount of overshoot or undershoot, occurring when the spin tub 20 reaches the maintenance rpm and is supported at the maintenance rpm, is relatively small.

On the contrary, in the spin tub 20 undergoing the sticking condition, as shown in FIG. 19, water is not drained, and thus the weight remains almost unchanged even when the rpm of the spin tub 20 increases. Furthermore, the water largely spreads up and down across the circumferential wall 20*a*. Because of this, the "inertia" of the spin tub 20 having the sticking condition is large, and the amount of shaking of rotation occurring when the spin tub 20 reaches the maintenance rpm r1, and maintains at the maintenance rpm r1 becomes large.

The second waterproof clothing determiner 201 determines whether there is the waterproof clothing Cwp based on the amount of shaking of rotation occurring when the spin tub 20 reaches the maintenance rpm r1.

Specifically, the second waterproof clothing determiner 201 detects an amount of shaking of rotation from an amount of variation of control voltage for the driving motor 30. The amount of shaking of rotation may be detected by a displacement sensor or rotation sensor, but the processor 60A receives the control voltage for the driving motor 30 from the voltage sensor 30*a*, and the control voltage has a high correlation with an actual rpm of the spin tub 20 and varies with changes in level of actual rpm.

Hence, to keep down structural complexity and rise in price of members, the second waterproof clothing determiner 201 is configured to calculate actual rpm of the spin tub 20 based on the control voltage and detect an amount of shaking of rotation.

Figure 21:
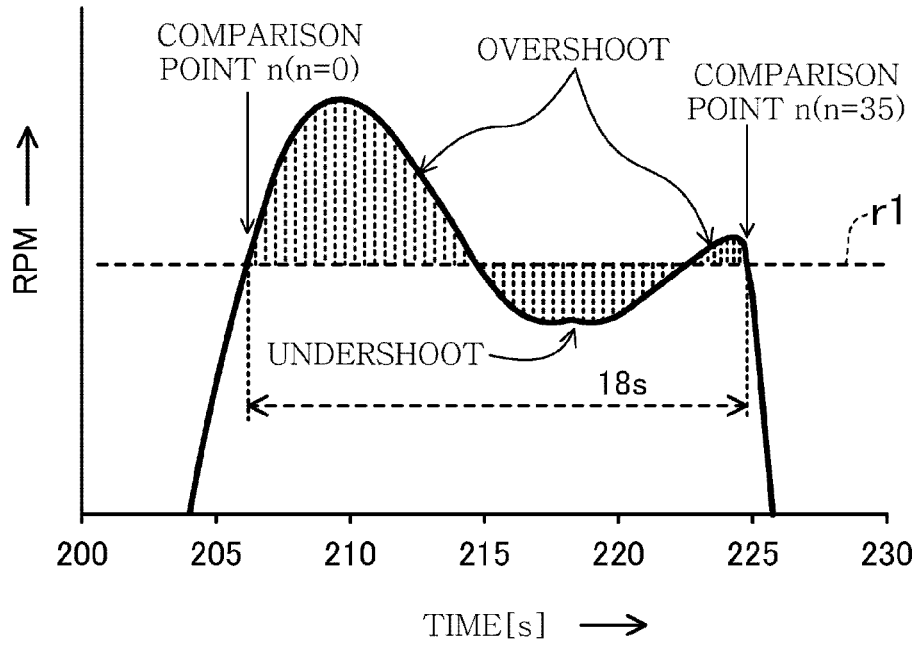
FIG. 21 is an enlarged view of a part of a rotation maintenance process for explaining calculation of an amount of shaking of the rotation.

FIG. 21 is an enlarged view of a part of the rotation maintenance process. The rotation controller 61 controls the driving motor 30 to accelerate to the maintenance rpm r1, and maintain the rotation when the maintenance rpm r1 is reached. However, the driving motor 30 may not follow the control because of the influence of the inertia of the spin tub 20, and exceeds (overshoot) or fall short of (undershoot) the targeted maintenance rpm r1 (herein, an amount of overshoot and an amount of undershoot are called an amount of shaking of rotation).

To detect the amount of shaking of rotation, the rotation controller 61 controls rotation to be performed at the maintenance rpm r1 for a certain period of time, e.g., for tens of seconds (rotation maintenance process). Further, during the rotation maintenance process, a certain time (18 seconds in this embodiment) after the maintenance rpm r1 is reached is subdivided at regular intervals (every 0.5 seconds in this embodiment) and a plurality of comparison points (36 points in this embodiment) are set.

For example, assuming that a control voltage value is input every 10 ms from the voltage sensor 30*a*, when each comparison point is passed after the maintenance rpm r1 is reached, 50 control voltage values are input to the processor 60A. The second waterproof clothing determiner 201 calculates an actual rpm RPM(i) based on each of the control voltage values. An absolute value (CALC_RPM(i)) of the difference between each actual rpm RPM(i) and the maintenance rpm r1 is then calculated (see equation (1)).

After the maintenance rpm r1 is reached, the second waterproof clothing determiner 201 accumulates the absolute values CALC_RPM(i) for the 36 comparison points in order (see equation (2)). The second waterproof clothing determiner 201 then deals with the accumulated value as a comparison value of an amount of shaking of rotation.

$$\text{CALC_RPM}(i) = |RPM(i) - r1| \tag{1}$$

$$\text{SUM_n} = \sum_{i=n\times 50}^{n\times 50+49} \text{CALC_RPM}(i)(n = 0, 1, \ldots 35) \tag{2}$$

For the second waterproof clothing determiner 201, a reference value is set for each point by an experiment in advance based on the amount of shaking of rotation for an occasion when there is normal clothing Cn only. When each comparison point is passed, the second waterproof clothing determiner 201 compares a reference value set for the comparison point with a comparison value of the amount of shaking of rotation corresponding to the reference value. When a comparison value of the amount of shaking of rotation exceeds a reference value at a comparison point, the second waterproof clothing determiner 201 determines that there is the waterproof clothing Cwp.

Like this, setting the plurality of comparison points and making a plurality of determinations at the different points may increase accuracy in determination.

Figure 22:
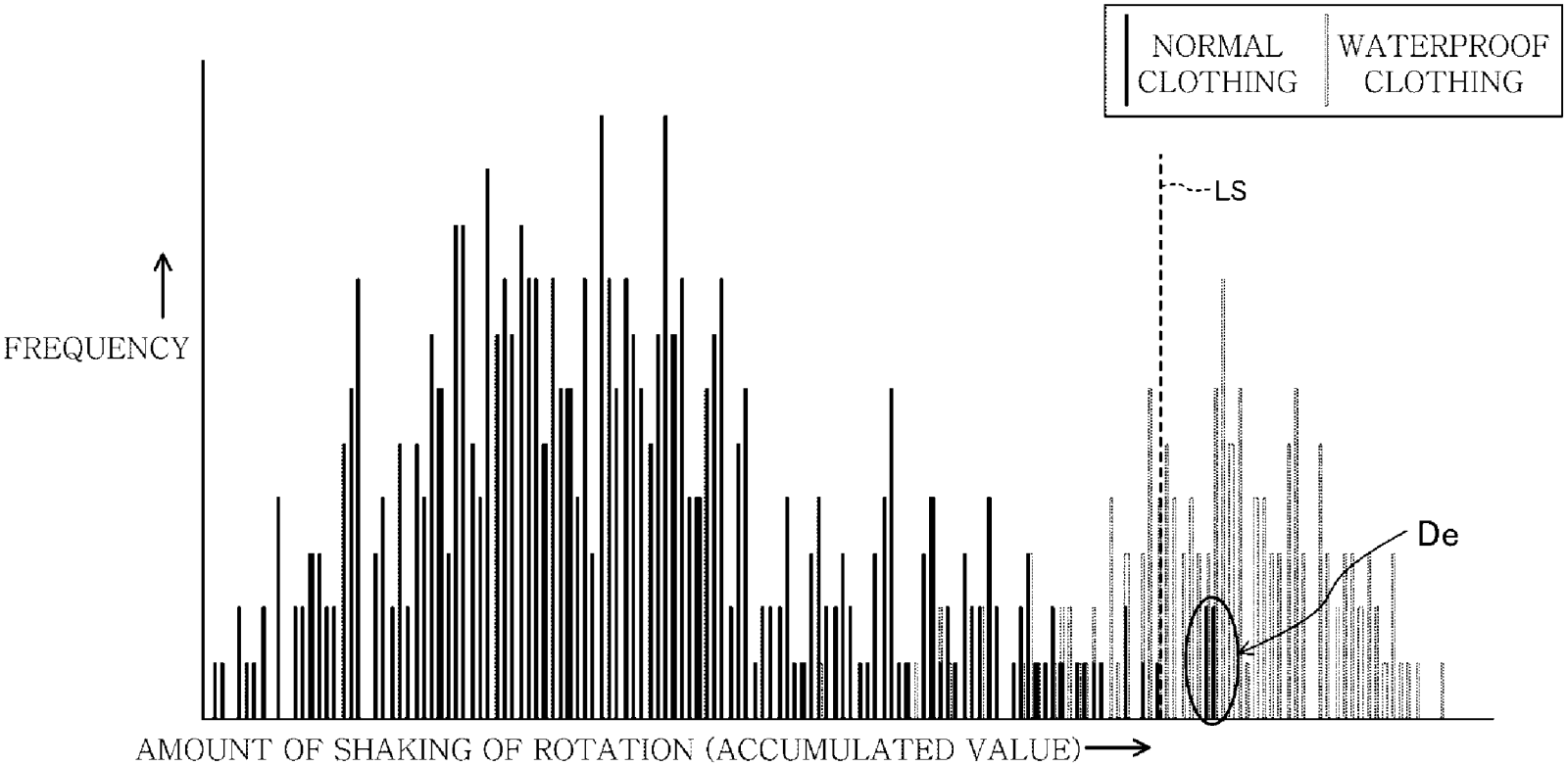
FIG. 22 shows frequency distribution of amount of shaking of rotation at an 11'th comparison point.

FIG. 22 shows frequency distribution of amount of shaking of rotation at the 11'th comparison point. The vertical axis corresponds to frequencies and the horizontal axis corresponds to comparison values of the amount of shaking of rotation (accumulated values at the 11'th comparison point). Solid lines indicate a case of the normal clothing Cn only, and the broken lines indicate a case that there is the waterproof clothing Cwp. Ls is an example of a reference value.

Like this, the presence or absence of the waterproof clothing Cwp makes difference in the comparison value of the amount of shaking of rotation, and also divides the frequency distribution into large or small. Accordingly, by setting the reference value Ls at a border in the frequency distribution and comparing the reference value Ls with the comparison value of amount of shaking of rotation, whether there is the waterproof clothing Cwp may be determined.

In this embodiment, such comparison is performed 36 times, and when a comparison value of the amount of shaking of rotation exceeds the reference value Ls in any comparison, the second waterproof clothing determiner 201 determines that there is the waterproof clothing Cwp.

A position of the reference value Ls may be set arbitrarily and adjusted to the situation.

By the way, as represented in arrow De in FIG. 22, even when there is the normal clothing Cn only, the comparison value of the amount of shaking of rotation may sometimes abnormally increase and although not often, exceptionally exceed the reference value Ls. Specifically, on an occasion when the normal clothing Cn is extremely lopsidedly distributed in the spin tub 20, making the vibration increase, or on an occasion when the normal clothing Cn is distributed in the spin tub 20 with good balance but the weight is extremely heavy, the comparison value of the amount of shaking of rotation increases abnormally.

In this case, the second waterproof clothing determiner 201 has detection error by determining that there is the waterproof clothing Cwp even when there is only the normal clothing Cn. An increase in the frequency of having detection error degrades the reliability.

Hence, in this washing machine, to avoid such detection error, the first and second detection error avoiders 202 and 203 are installed.

(First Detection Error Avoider 202)

The first detection error avoider 202 is configured to detect an occasion when the normal clothing Cn is distributed in the spin tub 20 with good balance but the weight is extremely heavy, leading to an abnormal increase in the comparison value of the amount of shaking of rotation. For example, the first detection error avoider 202 uses the fact that there is a difference in load variation according to whether there is the waterproof clothing Cwp, to determine that there is no waterproof clothing Cwp (load variation detection).

Specifically, in addition to the rotation maintenance process in the beginning of the spin-dry process, the rotation controller 61 performs a second rotation maintenance process to accelerate to and maintain a second maintenance rpm r2, which is lower than the maintenance rpm r1.

Figure 23:
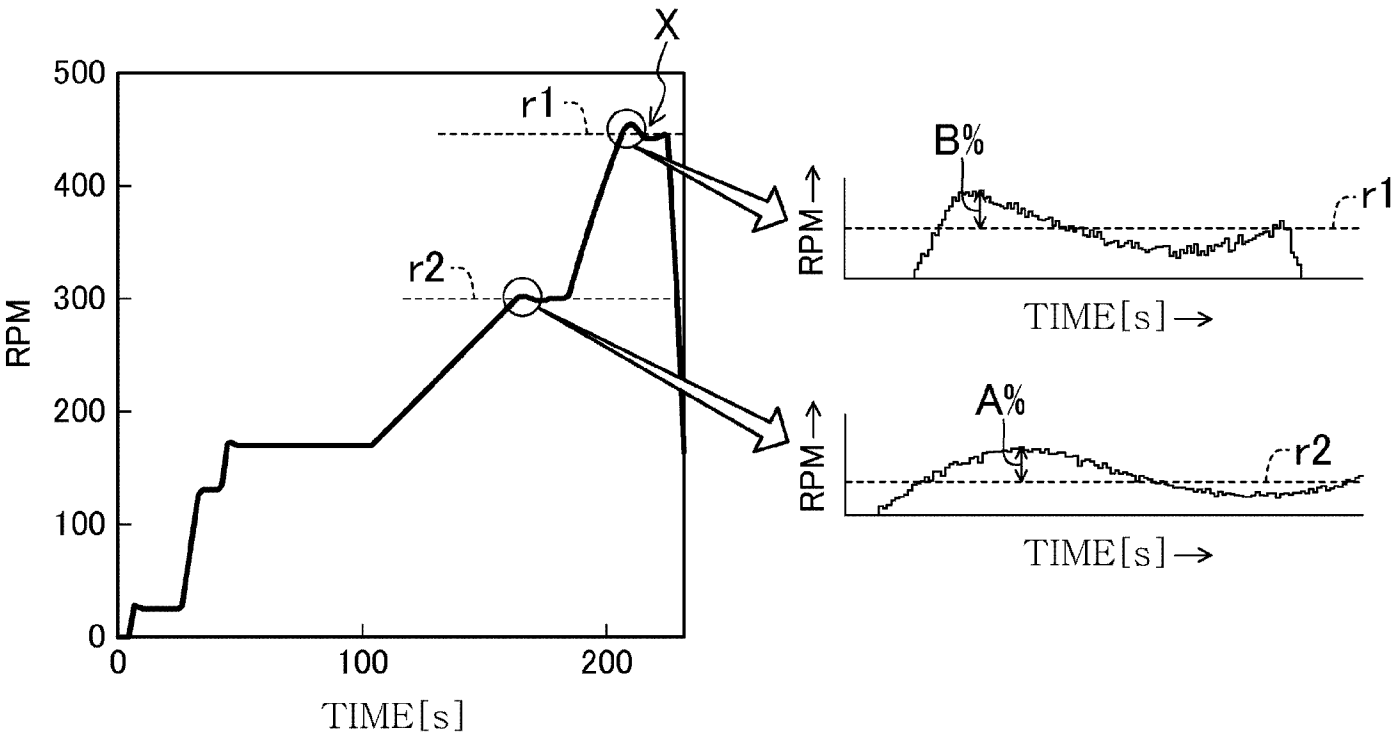
FIG. 23 shows rpm variance in a pre-spin for explaining a first detection error avoider.

FIG. 23 shows rpm variance in the pre-spin. In the pre-spin, prior to the rotation maintenance process to accelerate to and maintain the maintenance rpm r1, the second rotation maintenance process is performed to accelerate to and maintain the second maintenance rpm r2, which is lower than the maintenance rpm r1.

As shown in the enlarged view of FIG. 23, the rotation maintenance process and the second rotation maintenance process each have overshoot or undershoot. The first detection error avoider 202 calculates the maximum rpm r1max and r2max in the overshoots. It then calculates a rate of increase in each of the maintenance rpm r1 and the second maintenance rpm r2, A % and B % (see equation (3)).

$$A[\%]=r2\max/r2\times100-100$$

$$B[\%]=r1\max/r1\times100-100 \quad (3)$$

The first detection error avoider 202 then obtains a ratio of the rates of the increase, A %/B %, and assumes it as a comparison value for determination.

Figure 24:
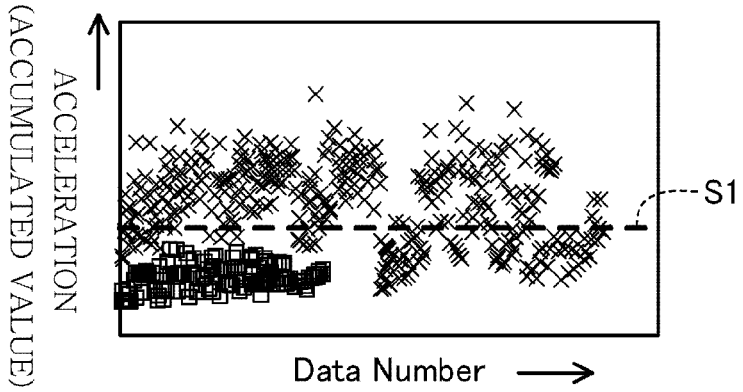
FIG. 24 shows a ratio of rates of increase of various sample data.

FIG. 24 shows a ratio of rates of the increase in different sample data on an occasion when there is the normal clothing Cn only and an occasion when the waterproof clothing Cwp is contained. Symbol □ indicates sample data on an occasion when the waterproof clothing Cwp is contained, and symbol× indicates sample data on occasion when there is the normal clothing Cn only.

On the occasion when there is the normal clothing Cn only, the weight decreases largely in the rotation maintenance process as compared to the second rotation maintenance process, so the ratio of rates of the increase increases, but on the occasion when there is the waterproof clothing Cwp, the weight remains almost unchanged, so the ratio of rates of the increase decreases. Hence, the presence or absence of the waterproof clothing Cwp makes difference in the ratio of rates of the increase, and also divides the distribution to large or small. Accordingly, by setting a threshold (the first threshold S1) at the border in the distribution and comparing the first threshold S1 with the ratio of rates of the increase, it may be determined that there is no waterproof clothing Cwp.

For example, a value of a ratio of rates of the increase, which is 10% greater than the maximum value of the ratio of rates of the increase on the occasion when the waterproof clothing Cwp is contained, is set to the first threshold S1. When the ratio of rates of the increase obtained as described above exceeds the first threshold S1, it is determined that there is no waterproof clothing Cwp, so that the first detection error avoider 202 may detect with high accuracy that there is no waterproof clothing Cwp.

(Second Detection Error Avoider 203)

The second detection error avoider 203 is configured to detect an occasion when the comparison value of the amount of shaking of rotation increases abnormally because the normal clothing Cn is mainly distributed to be extremely lopsided in the spin tub 20, making the vibration become large. For example, the second detection error avoider 203 uses the vibration sensor 19 and the fact that there is a difference in vibration according to whether there is the waterproof clothing Cwp, to determine that there is no waterproof clothing Cwp (vibration detection).

When the normal clothing Cn in a heavy state because it is insufficiently dehydrated, is distributed to be extremely lopsided in the spin tub 20, acceleration is made in a low-speed rotation region, making the vibration become large. On the contrary, when there is the waterproof clothing Cwp in the sticking condition, the balance is not significantly lost in the low-speed rotation region, so the vibration is also small. Hence, using the difference in vibration, the aforementioned state of the normal clothing Cn may be detected.

Although comparison may be made on vibrations at a certain low rpm in a certain direction, the second detection error avoider 203 is configured to compare vibrations at different rpm in multiple directions to increase accuracy in detection.

Specifically, the second detection error avoider 203 uses horizontal acceleration and vertical acceleration of the vibration sensor 19. Comparison is made in a two-part rpm area comprised of rotation region Z represented by arrow Z in FIG. 20 (a region in which the second-order resonance becomes large, a first rotation region) and a region X for rotation maintenance process in which rotation is made at the highest maintenance rpm r1 in the pre-spin (a second rotation region): four-point comparison.

The second detection error avoider 203 accumulates detection values of acceleration in each of the horizontal and vertical directions obtained from the vibration sensor 19 for a preset period of time in both the first and second regions, and uses the accumulated value as a comparison value.

Figure 25:
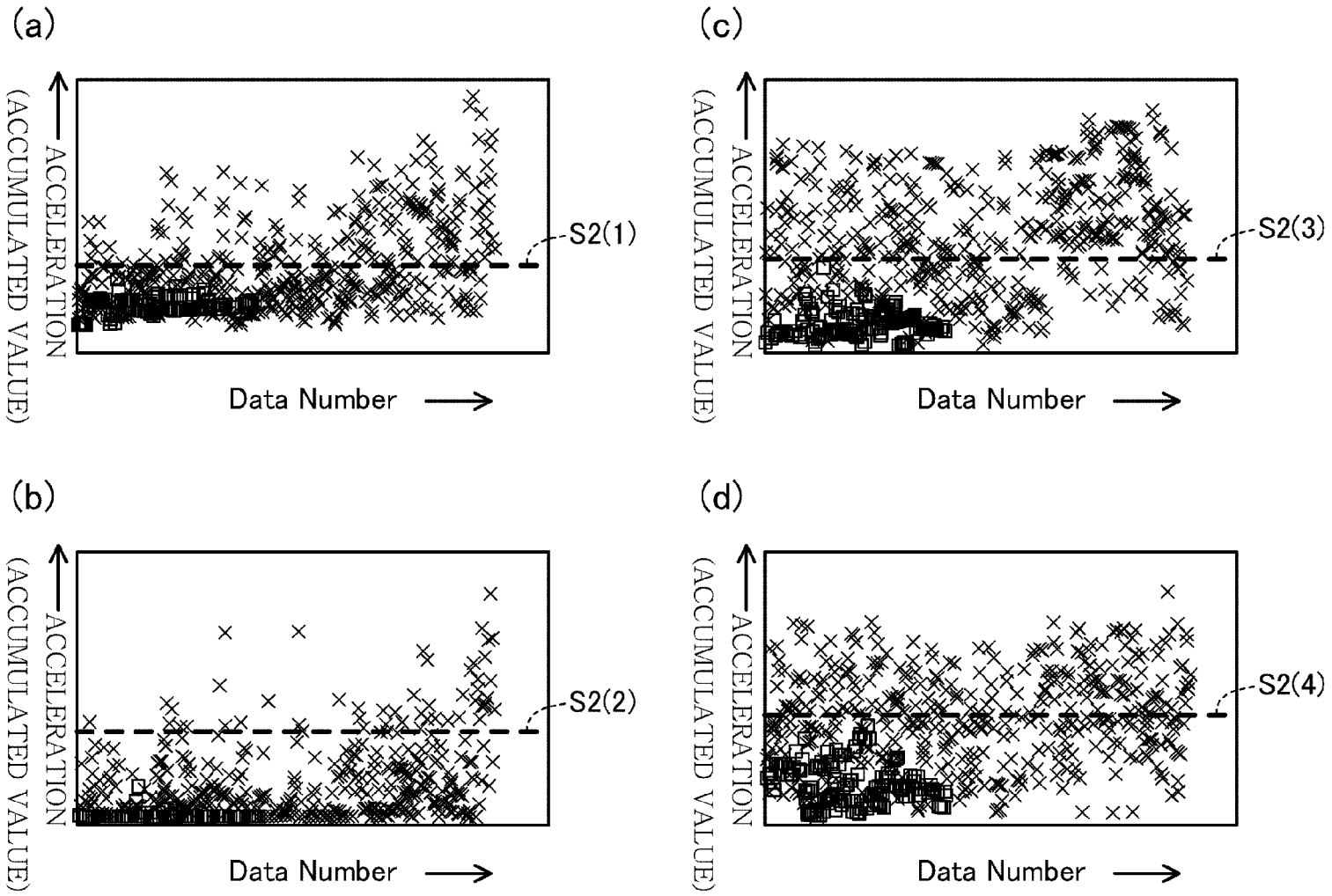
FIG. 25 shows acceleration detection values of various sample data, where (a) shows acceleration detection values in a first rotation region in the horizontal direction; (b) shows acceleration detection values in the first rotation region in the vertical direction; (c) shows acceleration detection values in a second rotation region in the horizontal direction; and (d) shows acceleration detection values in the second rotation region in the vertical direction.

FIG. 25 shows detection values (accumulated values) of acceleration in each of the horizontal and vertical directions in each rotation area for different sample data on an occasion when there is the normal clothing Cn only and an occasion when the waterproof clothing Cwp is contained. Symbol □ indicates sample data on an occasion when the waterproof clothing Cwp is contained, and symbol× indicates sample data on occasion when there is the normal clothing Cn only.

When there is the waterproof clothing Cwp, the vibration is small, so it may be distinguished from an occasion when there is the normal clothing Cn only. Accordingly, by setting a threshold (the second threshold S2) at the border in the distribution for each comparison point and comparing the second threshold with a corresponding comparison value, it may be determined that there is no waterproof clothing Cwp in four different conditions.

For example, for each comparison point, a value of the comparison value 10% greater than the maximum value of the comparison value for an occasion when the waterproof clothing Cwp is contained is set to the second threshold S2(1), S2(2), S2(3), or S2(4). Hence, for any comparison point, when the comparison value obtained exceeds the second threshold S2(1), S2(2), S2(3), or S2(4), it is determined that there is no waterproof clothing Cwp. This may enable the second detection error avoider 203 to accurately detect that there is no waterproof clothing Cwp.

Figure 26:
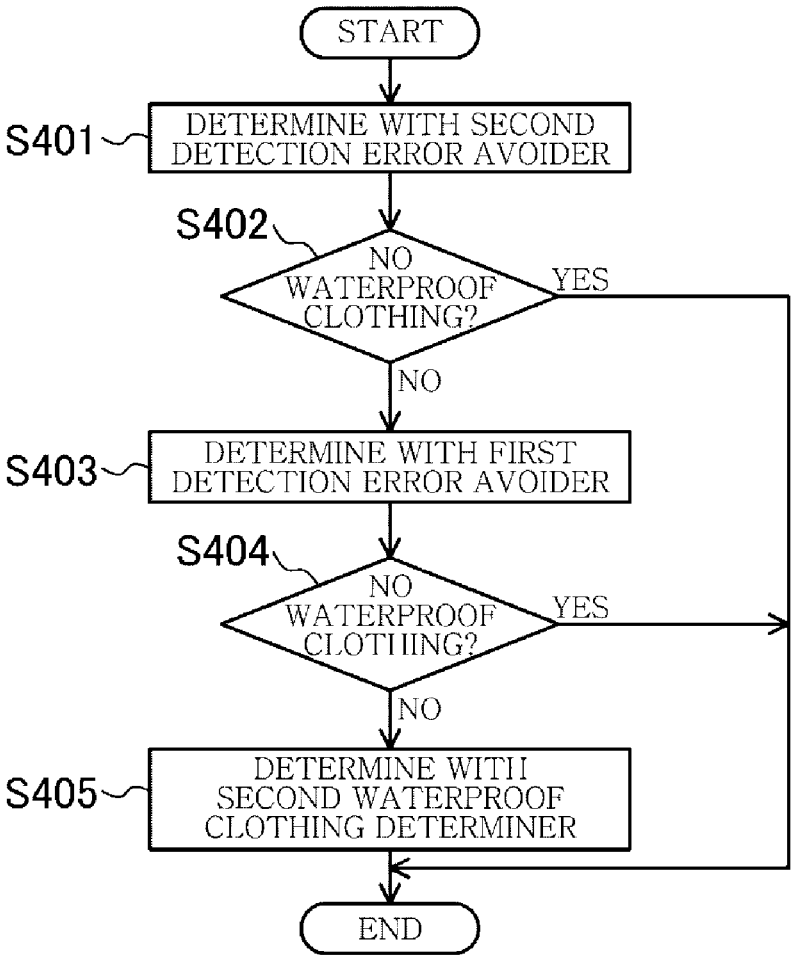
FIG. 26 is a flowchart illustrating a detailed process of a third determination apparatus.

FIG. 26 is a flowchart illustrating a detailed process of a third determination apparatus. First, it is determined by the second detection error avoider 203 whether there is the waterproof clothing Cwp, in step S401. When it is determined by the second detection error avoider 203 that there is no waterproof clothing Cwp, determination is not made by the second waterproof clothing determiner 201, in step S402. When it is not determined by the second detection error avoider 203 that there is no waterproof clothing Cwp, determination is made by the first detection error avoider 202, in step S403.

When it is determined by the first detection error avoider 202 that there is no waterproof clothing Cwp, determination is not made by the second waterproof clothing determiner 201, in step S404. As such, when it is not determined by the first detection error avoider 202 that there is no waterproof clothing Cwp, determination is made by the second waterproof clothing determiner 201, in step S405.

In this way, determination of whether the waterproof clothing Cwp is present with the second waterproof clothing determiner 201 is limited to an occasion when determination that there is no waterproof clothing Cwp is not made by neither the first detection error avoider 202 nor the second detection error avoider 203, so the detection error may be effectively avoided and the determination of whether there is the waterproof clothing Cwp may be made accurately.

Figure 27:
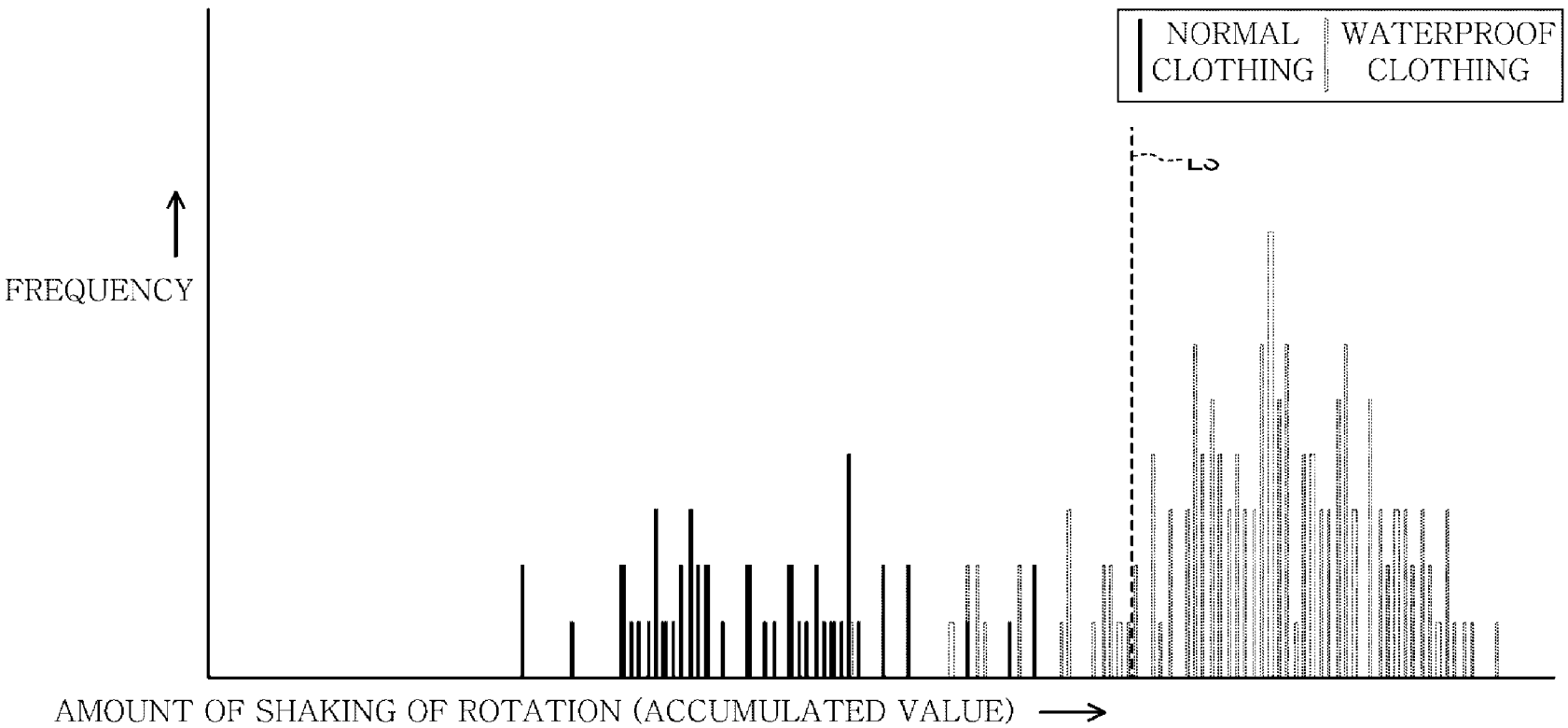
FIG. 27 shows frequency distribution of amount of shaking of rotation at an 11'th comparison point in a case of performing detection error avoidance.

FIG. 27 shows frequency distribution of the amount of shaking of rotation on an occasion when detection error avoidance is performed by both the first and second detection error avoiders 202 and 203 on the frequency distribution of the amount of shaking of rotation shown in FIG. 22. The main cause for detection error is clearly excluded as compared to the condition of FIG. 22, and the reference value Ls is set to be low, so it is seen that the accuracy in determination about the waterproof clothing Cwp is improved.

It is desirable that detection error avoidance is performed by both the first and second detection error avoiders 202 and 203, but it is fine to perform it with one of them. When the second waterproof clothing determiner 201 determines that there is the waterproof clothing Cwp, as in the first embodiment, it would be fine to rotate at certain low speed or stop the operation. Furthermore, the notification buzzer 6 may sound an alarm, or a display panel of the operator 2 or the terminal 80 may display an error message, to notify the user to call his/her attention.

It is also fine to combine them with the first waterproof clothing determiner 64 or the waterproof clothing predeterminer 65, the sign detector 66, etc., of the first embodiment. This may prevent abnormal vibration during the spin-dry even further.

Third Embodiment

A basic structure of the washing machine in the third embodiment is similar to the washing machine in the first and second embodiments. Hence, like reference symbols or numerals will be used for like elements, and the detailed description thereof will not be repeated.

In the washing machine of the third embodiment has software embedded in a processor 60B, which is different from those in the first and second embodiments. Specifically, the washing machine in the third embodiment includes an apparatus for preventing abnormal vibration during the spin-dry, which is different from the washing machine as in the first and second embodiments. The driving motor 30 constitutes a "driver" in the third embodiment.

The processor 60B is a known microcomputer-based controller, and includes a central processing unit (CPU) for running a program, a memory comprised of e.g., a RAM, a ROM, or the like for storing the program and data, an I/O bus for inputting/outputting electric signals, and an intelligent power module (IPM) comprised of switching devices for driving the driving motor 30.

Figure 28:
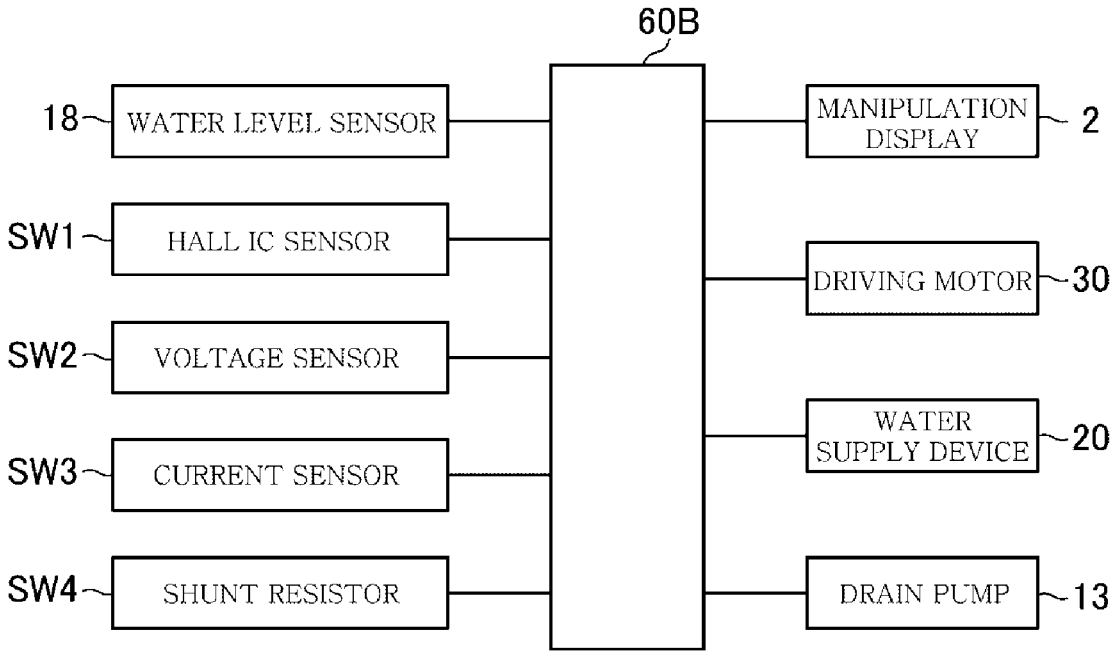
FIG. 28 is a block diagram illustrating major relationships between a processor and the respective components of a washing machine, according to a third embodiment of the disclosure.

The processor 60B receives signals detected by various sensors, as shown in FIG. 28. The various sensors include the following ones: the water level sensor 18, a hall IC sensor SW1 for detecting rpm of the driving motor 30, a voltage sensor SW2 for detecting applied voltage to the driving motor 30, a current sensor SW3 for detecting applied current to the driving motor 30, and a shunt resistor SW4.

The processor 60B performs a similar spin-dry process to that of the washing machine in the first and second embodiments.

Figure 30:
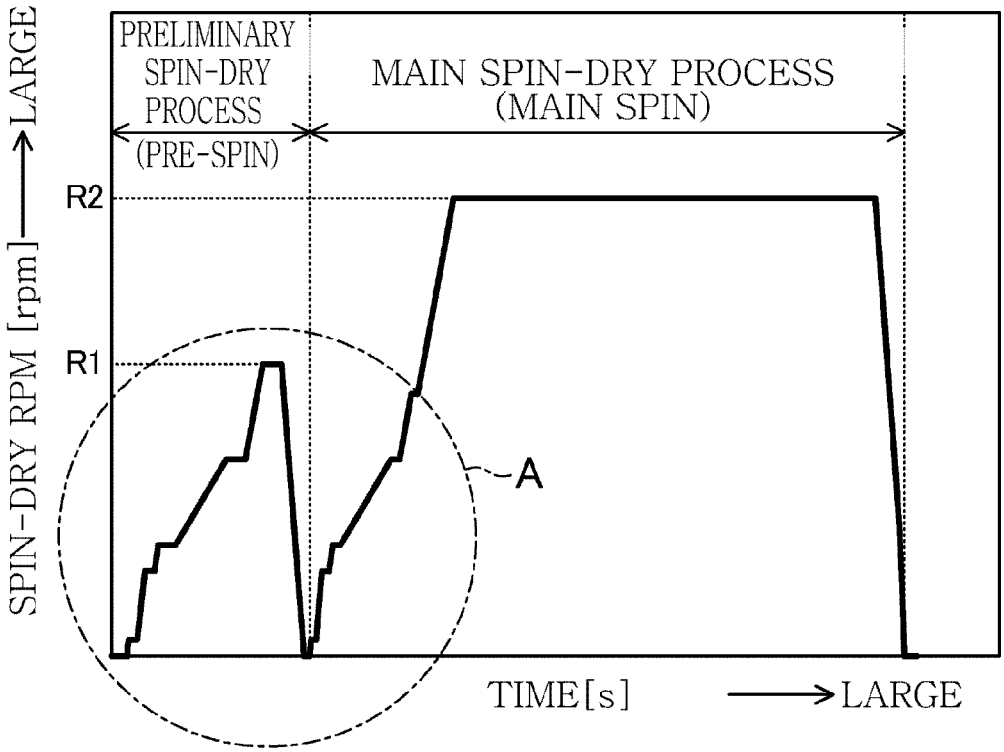
FIG. 30 is a diagram illustrating a spin-dry profile in a spin-dry process.

Specifically, as shown in FIG. 30, the spin-dry process includes a preliminary spin-dry process (pre-spin) in which the rpm of the spin tub 20 reaches to an intermediate rotation area (up to about 400 to 500 rpm in this embodiment), and a main spin-dry process (main spin) in which it reaches to a high-speed rotation area (up to about 500-1,000 rpm).

The preliminary spin-dry process is a process to resolve the lopsided weight of the laundry C, in which to accelerate the spin tub 20 to the first rpm r1 (about 450 rpm in this embodiment) and then maintain the rotation at the first rpm r1 for a certain period of time. The main spin-dry process is a process to spin-dry the laundry C, in which to accelerate the spin tub 20 to the second rpm r2 (about 700 rpm in this embodiment) and then maintain the rotation at the second rpm r2 for a certain period of time.

Figure 31:
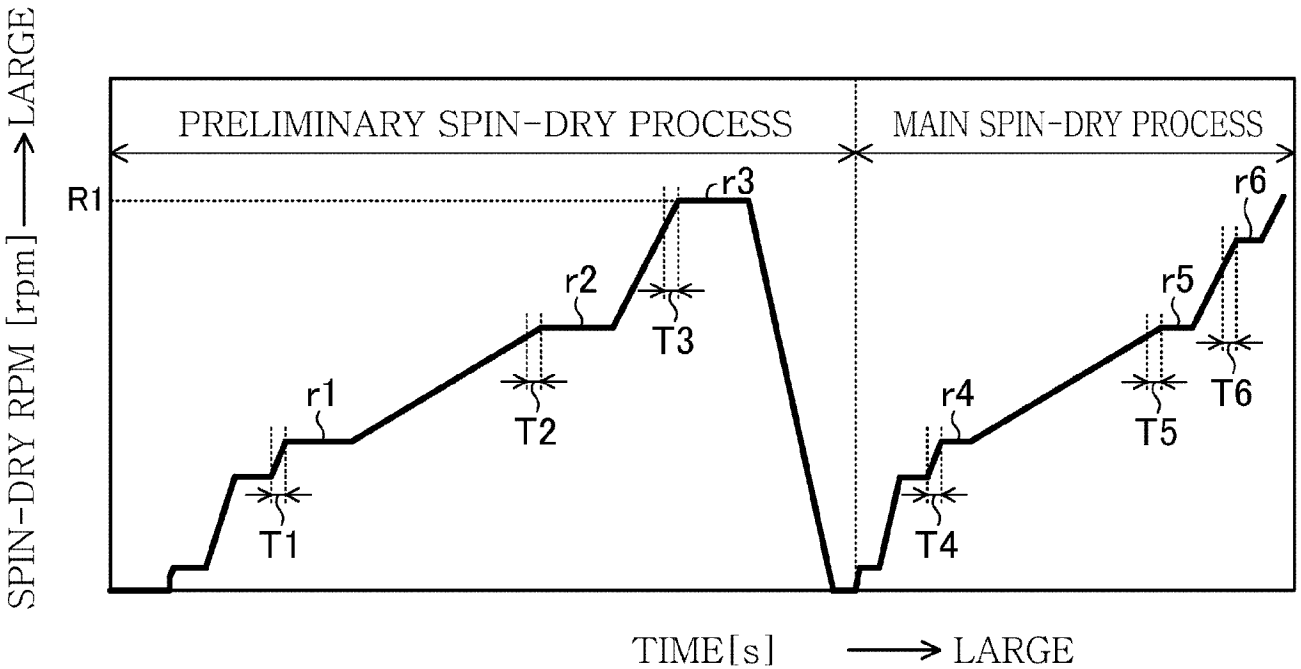
FIG. 31 is an enlarged view of a part of a spin-dry profile.

FIG. 31 is an enlarged view of encircled part A of FIG. 30. As shown in FIG. 31, both the preliminary spin-dry process and the main spin-dry process are supposed to ratchet up the rpm of the driving motor 30. This may enable smooth driving of the driving motor 30.

In other words, when the rpm is rectilinearly increased to reach a high rpm as quickly as possible, the water released from the laundry C or bubbles created from the residual detergent in the laundry C may sometimes become resistance. In this case, the rpm may not likely to increase as in the spin-dry profile. Accordingly, as shown in FIG. 31, whenever the rpm increases to some extent, the spin tub 20 is forced to be rotated at certain rpm (i.e., stepwise increase in the rpm). This may secure time for which to get rid of the washed water or the bubbles, and further ensure to increase the rpm.

The processor 60B detects whether there is the waterproof clothing Cwp and prevents occurrence of abnormal vibration.

Figure 29:
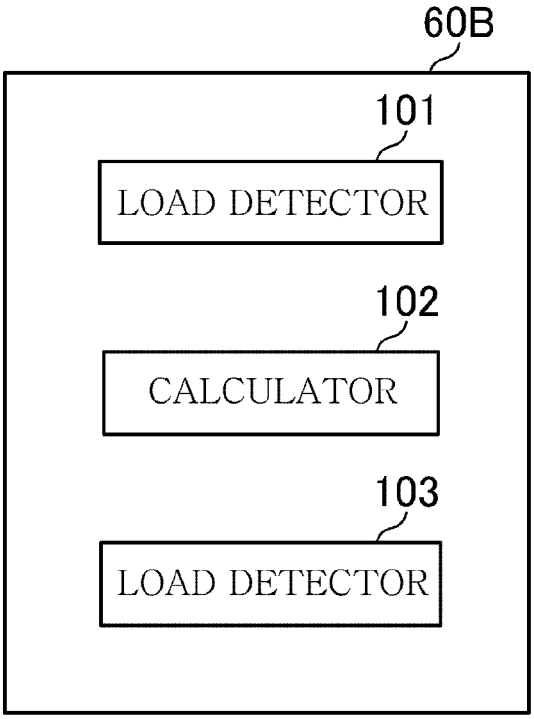
FIG. 29 is a schematic block diagram of a processor.

Specifically, the processor 60B includes, as shown in FIG. 29, a load detector 101 for converting a rotation load of the spin tub 20 into a rotating coordinate system that is rotated in sync with the motor rotation and detecting the result, a calculator 102 for calculating an amount of variation ΔVi of the rotation load for a certain period of time Ti, where i=1, 2, . . . 6, in the spin-dry process based on the detection result of the load detector 101, and a determiner 103 for determining whether there is a sign of abnormal vibration based on the calculation result of the calculator 102.

The load detector 101 detects a torque voltage Vi (i=1, 2, . . . , 6 of the driving motor 30 as a physical quantity representing the rotation load of the spin tub 20. The torque voltage Vi is determined based on a detection signal from the voltage sensor SW2. In this embodiment, the load detector 101 detects the torque voltage Vi for each of the six periods Ti (i=1, 2, . . . , 6 defined while in the preliminary spin-dry process and the main spin-dry process.

Specifically, the load detector 101 detects the torque voltages Vi for three periods T1 to T3 set while the spin-tub 20 is being accelerated in the preliminary spin-dry process and for three periods T4 to T6 set while the spin-tub 20 is being accelerated in the main spin-dry process. Each period Ti is set as a term from right before a confirmed predefined rpm ri (i=1, 2, . . . , 6 (specifically, the rpm lower than the confirmed rpm ri by 5 to 10 rpm) up to the confirmed rpm ri.

Furthermore, in this embodiment, the confirmed rpm ri is equal to a constant rpm at which the spin-tub 20 is rotated (see FIG. 31). The term "constant rpm" as herein mentioned refers to a point at which a target value of the rpm becomes constant. The actual rpm may sometimes fluctuate around the target value as a result of the influence of overshoot or undershoot. Furthermore, setting the confirmed rpm ri is not limited to what is shown in FIG. 31.

For each period Ti, the calculator 102 calculates the amount of variation ΔVi (i=1, 2, . . . , 6 of the torque voltage Vi detected for the period Ti. The amount of variation ΔVi is equal to the difference obtained by subtracting the minimum value of the torque voltage Vi from the maximum value. For example, assuming that the torque voltage V1 is detected 100 times for a period T1, the calculator 102 determines the maximum and minimum values among the 100 torque voltages V1 and takes the result of subtraction as the amount of variation ΔVi. The calculator 102 also multiplies the amounts of variation ΔV1~ΔV6 by each other and outputs a determination value Vp that represents the multiplication result to the determiner 103. Specifically, the determination value Vp is calculated based on the following equation (4).

$$Vp=\Delta V1\cdot\Delta V2\cdot\Delta V3\cdot\Delta V4\cdot\Delta V5\Delta V6 \quad (4)$$

As seen from the equation (4), the determination value Vp is equal to the sixth power of a geometric mean of the amounts of variation ΔVi. The determination value Vp is an example of an index that represents a mean value of the amounts of variation ΔVi.

The determiner 103 compares the determination value Vp output from the calculator 102 with a predefined threshold Vt. When the determination value Vp is greater than the threshold Vt as expressed in the following equation (5), the determiner 103 determines that there is a sign of abnormal vibration.

$$Vt<Vp \quad (5)$$

As seen from the equation (5), it is equal to comparison of the geometric mean of the amounts of variation ΔVi with a certain value (specifically, the one sixth power of the threshold Vt).

In other words, in the case that there is the normal clothing Cn only permeable to water, imbalance hardly occurs. In this case, for example, when the rpm is being uniformly accelerated without a hitch, water is released due to the rise of the rpm and the weight of the laundry is reduced, so the torque voltage Vi and the amount of variation ΔVi become gradually small as much an amount as the weight is the reduced.

Figure 32:
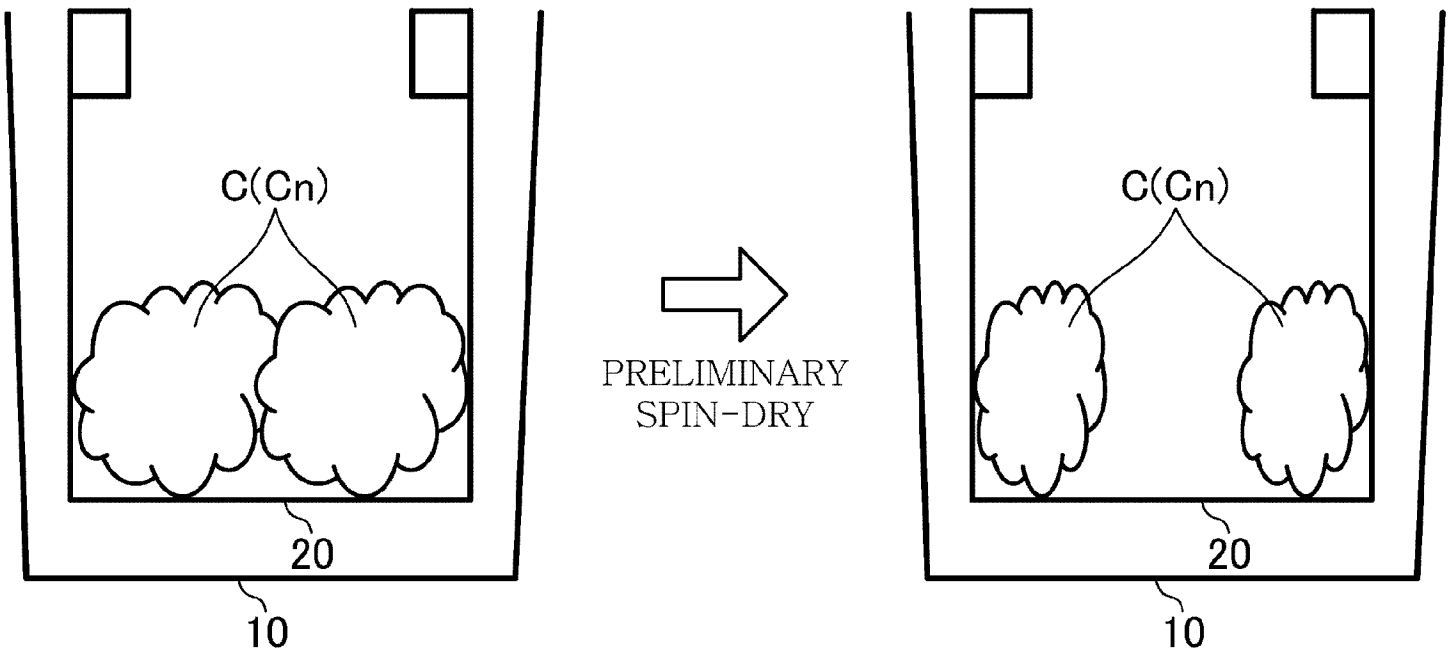
FIG. 32 shows comparison between states of normal clothing before and after a preliminary spin-dry process.

Furthermore, as shown in FIG. 32, with the preliminary spin-dry process, the water contained in the normal clothing Cn is released and the weight of the normal clothing Cn becomes light. When the main spin-dry process is performed on the laundry that has become light, the weight is further reduced and the torque voltage Vi becomes smaller. Hence, as compared to the torque voltage Vi (i=1 to 3) detected in the preliminary spin-dry process, the torque voltage Vi (i=4 to 6) detected in the main spin-dry process is mostly reduced.

As such, as the magnitude of the torque voltage Vi itself is reduced over the preliminary spin-dry process and the main spin-dry process and the amount of variation ΔVi also becomes relatively small, the magnitude of the determination value Vp becomes relatively small.

On the other hand, when the waterproof clothing Cwp is contained, the amount of variation ΔVi of the torque voltage Vi becomes relatively large. In this case, for example, when the rpm is in the low- to middle-speed rotation regions, the weight of the laundry is not reduced as compared to the occasion when there is the normal clothing Cn only because the water enclosed by the waterproof clothing Cwp is not released even though the spin-dry process has been performed. This causes the torque voltage Vi and its amount of variation ΔVi to relatively increase.

Figure 33:
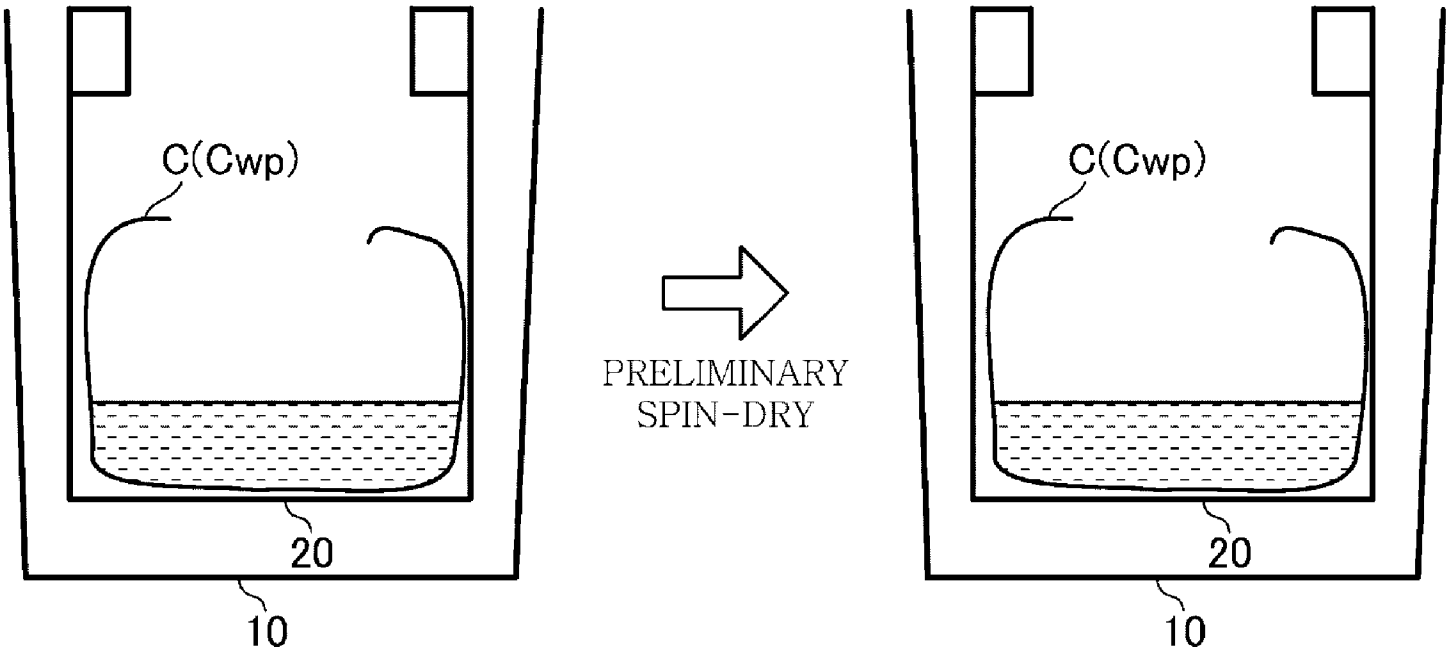
FIG. 33 shows comparison between states of waterproof clothing before and after a preliminary spin-dry process.

In this case, as shown in FIG. 33, even when the preliminary spin-dry process is performed, the enclosed water is not sufficiently released, and the weight change is small as compared to the normal clothing Cn. Even when the main spin-dry process is performed in this state, the weight is not that changed as compared with the preliminary spin-dry process, and the torque voltage Vi of the driving motor 30 is not changed as much as in the occasion of the normal clothing Cn.

As such, when the waterproof clothing Cwp that encloses water is mixed into the laundry C, it is reflected in the magnitude of the torque voltage Vi and the amount of variation ΔVi. In this case, as the magnitude of the torque voltage Vi itself is not reduced as much as for the normal clothing Cn but the amount of variation ΔVi becomes relatively large, the magnitude of the determination voltage Vp becomes relatively large.

The processor 60B controls the driving motor 30 after receiving the determination of the determiner 103. Specifically, the processor 60B controls operation of the driving motor 30 to rotate the spin tub 20 at speed equal to or less than a predefined third rpm R3 in the spin-dry process when the determiner 103 determines that there is a sign of abnormal vibration. The third rpm R3 is set in the middle-speed rotation region, and substantially equal to the first rpm r1 set as the maximum rpm of the preliminary spin-dry process in this embodiment.

A detailed process of determining a sign of abnormal vibration will now be described with reference to a flowchart of FIG. 34.

First, in step S1, the processor 60B determines whether a spin-dry process is initiated. When the determination is yes, the process proceeds to step S2, but when it is no, the processor 60B waits until a spin-dry process is initiated.

when a spin-dry process is initiated, the processor 60B starts the preliminary spin-dry process by driving the driving motor 30 based on a spin-dry profile as shown in FIGS. 30 and 31. In this case, the rpm of the driving motor is ratcheted up toward the first rpm r1. As described above, the load detector 101 detects the torque voltage Vi while the rpm of the driving motor 30 is being accelerated without a hitch in the preliminary spin-dry process.

Specifically, in step S2 following the step S1, the load detector 101 reads a first table in which the confirmed rpm ri (i=1 to 3) is stored for the preliminary spin-dry process.

Next, in step S3, the load detector 101 detects the torque voltage Vi for a certain period Ti for which the confirmed rpm ri is reached from an rpm right before the confirmed rpm ri. For each period Ti, the torque voltage Vi is detected multiple times.

Next, in step S4, the load detector 101 determines a maximum Vi(max) and minimum Vi(min) of the torque voltage Vi for each period Ti.

Next, in step S5, the processor 60B determines whether detection of the torque voltage Vi for the confirmed rpm ri stored in the first table is completed (i.e., whether detection over the first half three periods is completed). When the determination is yes, the process proceeds to step S6, but when it is no, the process goes back to step S3.

After completion of detection of the torque voltage Vi for the preliminary spin-dry process, the rpm of the driving motor 30 reaches the first rpm r1. After that, the processor 60B controls operation of the driving motor 30 to maintain the first rpm r1. After continuation of such control over a predefined period of time, the processor 60B reduces the rpm of the driving motor 30 toward zero.

After the rpm of the driving motor 30 reaches zero, the processor 60B stops the preliminary spin-dry process and starts the main spin-dry process. In this case, the rpm of the driving motor is ratcheted up toward the second rpm r2. As described above, the load detector 101 detects the torque voltage Vi while the rpm of the driving motor 30 is being accelerated without a hitch not only in the preliminary spin-dry process but also in the main spin-dry process.

Specifically, in the step S6 following the step S5, the load detector 101 reads a second table in which the confirmed rpm ri (i=4 to 6) is stored for the main spin-dry process.

Next, in step S7, the load detector 101 detects the torque voltage Vi for a certain period Ti for which the confirmed rpm ri is reached from an rpm right before the confirmed rpm ri. For each period Ti, the torque voltage Vi is detected multiple times.

Next, in step S8, the load detector 101 determines a maximum Vi(max) and minimum Vi(min) of the torque voltage Vi for each period Ti.

Next, in step S9, the processor 60B determines whether detection of the torque voltage Vi for the confirmed rpm ri stored in the second table is completed (i.e., whether detection over the second half three periods is completed). When the determination is yes, the process proceeds to step S10, but when it is no, the process goes back to step S7.

Next, in step S10, the calculator 102 calculates an amount of variation ΔVi based on the maximum Vi(max) and minimum Vi(min) of the torque voltage Vi determined for each of the certain periods T1 to T6.

In step S11, the calculator 102 calculates the determination value Vp based on the equation (4).

In step S12, the determiner 103 compares the determination value Vp with the threshold Vt based on the equation (5). When the determination value Vp is equal to or less than the threshold Vt (no in step S12), the flows shown in FIG. 34 are stopped and the main spin-dry process is followed, and when the determination value Vp is greater than the threshold Vt, the processor 60B proceeds to step S13, changes the spin-dry profile, and stops the flows. In the latter case, as shown in FIG. 35, the highest rpm for the main spin-dry process is supposed to be changed from the second rpm R2 to the third rpm R3.

The process from the step S10 to S12 is performed before the rpm of the driving motor 30 reaches the high-speed rotation region. To realize this, detection of the torque voltage Vi (specifically, the process from the step S2 to S9) is performed when the rpm of the driving motor 30 is in the low-speed to middle-speed rotation regions (specifically, at about 200 to 500 rpm).

(Summary)

Figure 34:
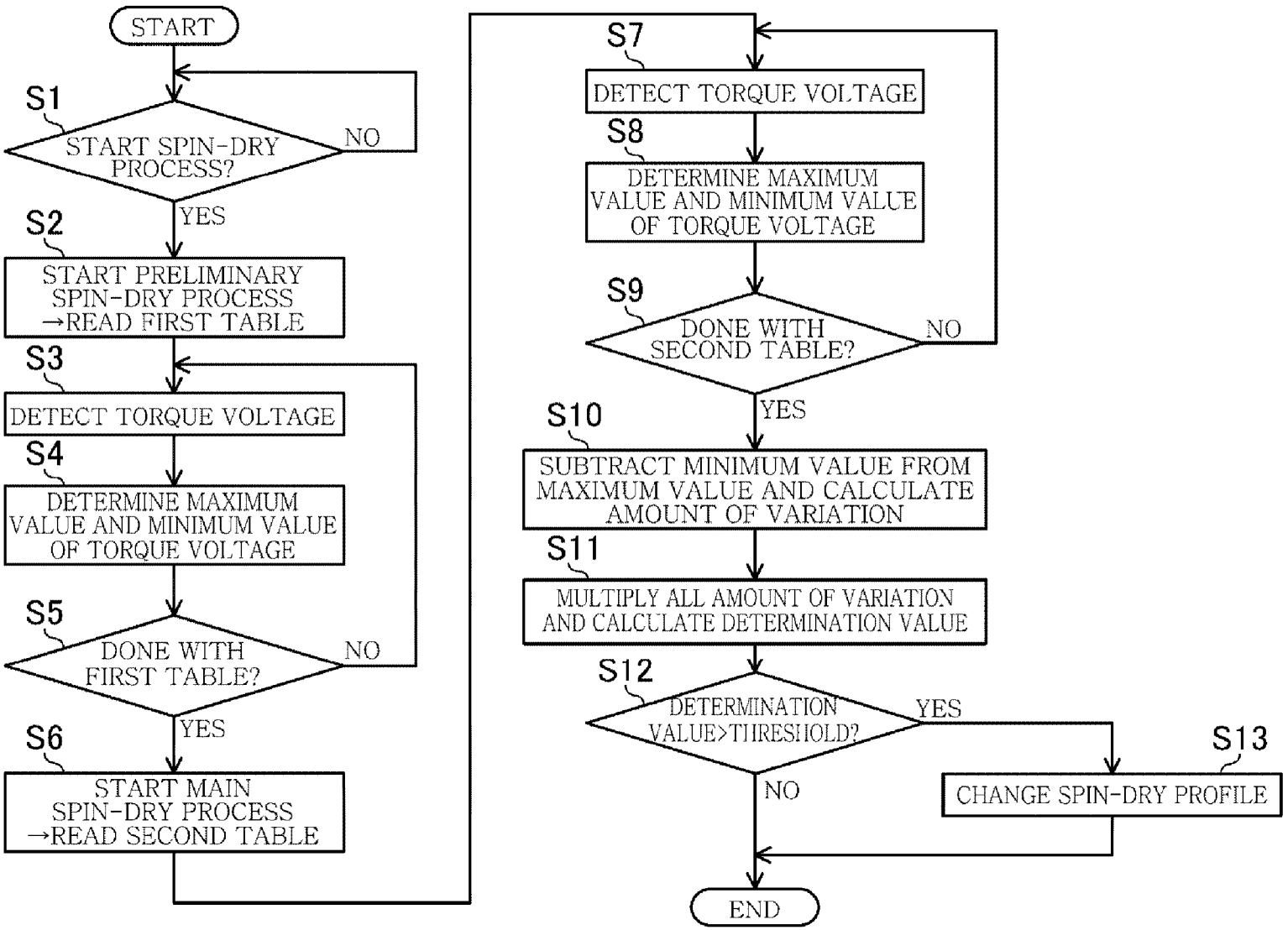
FIG. 34 is a flowchart illustrating a process of determining a sign of abnormal vibration.
Figure 35:
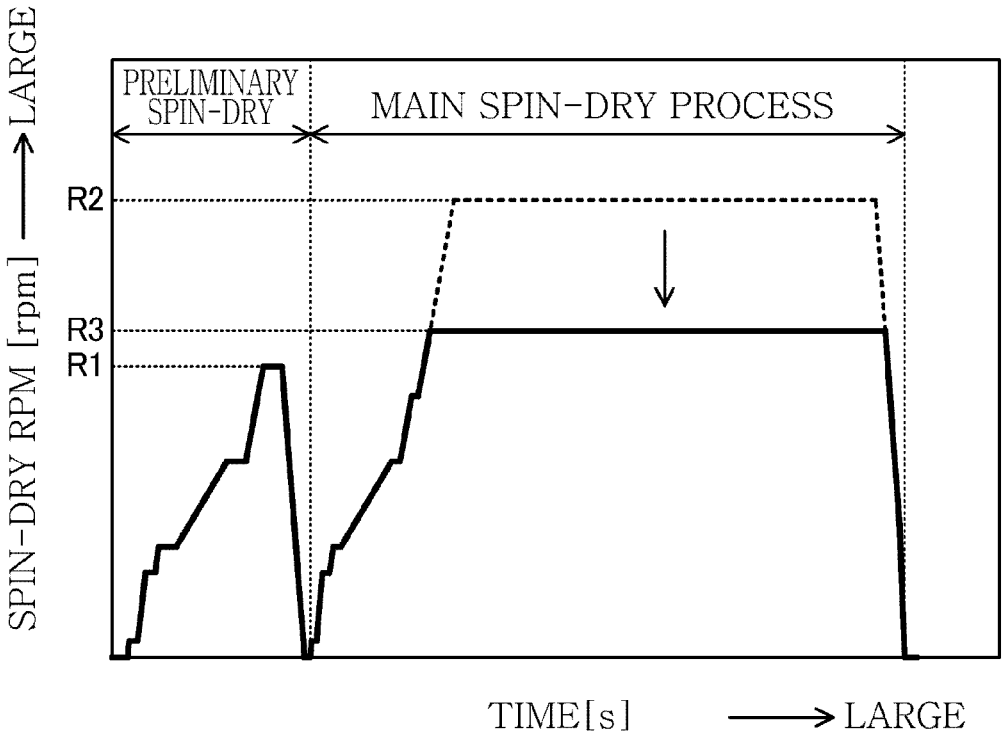
FIG. 35 shows a spin-dry profile when it is determined that there is a sign of abnormal vibration.

As described above, the washing machine according to this embodiment takes the amount of variation ΔVi of the torque voltage Vi into account according to the flows shown in FIG. 34. Specifically, as shown in FIG. 31, the washing machine determines that there is a sign of abnormal vibration, i.e., that the waterproof clothing Cwp that encloses water is mixed into the laundry C when a geometric mean of the amounts of variation ΔV1~ΔV6 determined in a total of 6 periods is greater than a certain value.

Because the determination is supposed to made by referring to detection results in the spin-dry process, it may deal with a situation in which the spin-dry process is only performed without washing or rinsing process. Such a situation is assumed particularly for the waterproof clothing Cwp, and is thus effective to prevent abnormal vibration caused by the waterproof clothing Cwp.

With the above configuration, before abnormal vibration occurs, the sign may be determined in time.

Furthermore, as expressed in the equations (4) and (5), instead of comparing the amount of variation ΔVi itself with the threshold Vt, comparison is made based on the geometric mean of the amount of variation ΔVi, thereby suppressing influence of detection error of the torque voltage Vi and having the benefit of proper determination of a sign of abnormal vibration before the abnormal vibration occurs.

Moreover, as described above, when the waterproof clothing Cwp that encloses water is accommodated in the spin tub 20 and it is determined that there is a sign of abnormal vibration, the processor 60B is configured to rotate the spin tub 20 at speed equal to or less than the third rpm R3 in the spin-dry process, as shown in FIG. 35. For example, in a case that the highest rpm of the spin tub 20 is set to about 700 rpm in a normal spin-dry process, when it is determined that there is a sign of abnormal vibration, a maximum rpm of the spin tub 20 may be set to about e.g., 500 rpm for the spin-dry process.

Accordingly, occurrence of abnormal vibration caused by the waterproof clothing Cwp that encloses water may be prevented and the spin-dry process may be completed without stopping the operation of the washing machine.

(Modifications)

Although the torque voltage Vi of the driving motor 30 is detected as a physical quantity representing the rotation load of the spin tub 20 in the third embodiment, the disclosure is not limited thereto. Instead of the torque voltage Vi, a torque current of the driving motor 30, for example, may also be used. In this case, the torque current may be obtained based on the detection result from the current sensor SW3 and/or the shunt resistor SW4. Alternatively, the torque voltage and torque current are both detected and based on a combination of them, a sign of abnormal vibration may be determined.

Furthermore, although the washing machine determines whether there is a sign of abnormal vibration based on the determination value Vp obtained by having the amounts of variation ΔVi calculated for a plurality of periods (a total of six periods in the drawings) multiplied together, but is not limited thereto. For example, based on comparison between a value resulting from multiplying the amounts of variation ΔVi (i=1 to 3) obtained in the preliminary spin-dry process together and a value resulting from multiplying the amounts of variation ΔVi (i=4 to 6) obtained in the main spin-dry process together, whether there is a sign of abnormal vibration may be determined.

Moreover, the washing machine is configured to determine whether there is a sign of abnormal vibration based on the amount of variation ΔVi obtained for each period Ti, but is not limited thereto. For example, the washing machine may determine whether there is a sign of abnormal vibration based on an arithmetic mean of the torque voltage Vi for a certain period Ti.

Specifically, in this case, the calculator 102 calculates the arithmetic mean of the rotation load (torque voltage Vi) for each period Ti during the spin-dry process, and the determiner 103 determines whether there is a sign of abnormal vibration based on the arithmetic mean calculated by the calculator 102. As in the above embodiment where the torque voltage Vi is detected over the total of six periods, the calculator 102 calculates the arithmetic mean for each of the six periods.

When the waterproof clothing Cwp that encloses water is mixed into the laundry C, it is reflected in the magnitude of the torque voltage Vi. For example, when the waterproof clothing Cwp that encloses water is contained in the spin tub 20, as described above, the torque voltage Vi generally increases. As the torque voltage Vi increases, its arithmetic mean increases as well.

With the above configuration, before abnormal vibration occurs, the sign may be determined in time.

In another example, the washing machine may determine whether there is a sign of abnormal vibration based on a maximum value of the torque voltage Vi for a certain period Ti.

Specifically, in this case, the calculator 102 determines the maximum value of the rotation load (torque voltage Vi) for each period Ti during the spin-dry process, and the determiner 103 determines whether there is a sign of abnormal vibration based on the maximum value determined by the calculator 102. As in the above embodiment where the torque voltage Vi is detected over the total of six periods, the calculator 102 calculates the maximum value for each of the six periods.

When the waterproof clothing Cwp that encloses water is mixed into the laundry C, it is reflected in the magnitude of the torque voltage Vi. For example, when the waterproof clothing Cwp that encloses water is contained in the spin tub 20, as described above, the torque voltage Vi generally increases. As the torque voltage Vi increases, its maximum value increases as well.

With the above configuration, before abnormal vibration occurs, the sign may be determined in time.

Furthermore, although detection of the torque voltage Vi is performed while the rpm of the spin tub 20 is rising without a hitch, it is not limited thereto. For example, when the spin tub 20 is decreasing without a hitch, the torque voltage Vi may be detected, or when angle acceleration of the spin tub 20 is being changed without a hitch, the torque voltage Vi may be detected. Moreover, it may be detected in combinations of two or more of the occasions when the rpm of the spin tub 20 is rising without a hitch, decreasing without a hitch, and its angular acceleration is changing without a hitch.

Although the spin-dry process after rinsing is illustrated, the above configuration may be applied for an intermediate spin-dry process performed between washing and rinsing processes. In this case, whether there is a sign of abnormal vibration is determined based on the rotation load detected during the intermediate spin-dry process.

Furthermore, although a scenario where the main spin-dry process is performed right after the preliminary spin-dry process is performed once as an example of the spin-dry profile is described, the disclosure is not limited thereto. The preliminary spin-dry process may be performed multiple times. In this case, for each of the multiple spin-dry processes, the rotation load may be detected.

Moreover, although a scenario where the main spin-dry process is initiated after the preliminary spin-dry process is stopped and the rpm of the driving motor 30 reaches zero is illustrated, the disclosure is not limited thereto. For example, after the preliminary spin-dry process is stopped and the rpm of the driving motor 30 is reduced to certain rpm (higher than zero) in a low-speed rotation region, the main spin-dry process may be initiated.

In addition, although the disclosure shows that the torque voltage Vi is detected in both the preliminary spin-dry process and the main spin-dry process, it is not limited thereto. The torque voltage Vi may be detected for at least one of the preliminary spin-dry process and the main spin-dry process. In this case, the threshold Vt may be changed by an amount of increase or decrease of the detection period of the torque voltage Vi.

However, the washing machine is not limited to what is described above in the first to third embodiments, and may include other various components. For example, the technologies as described in the embodiments may be combined to fit some specifications of the washing machine. The washing machine may be implemented with the technology as described in the first embodiment and the technology as described in the second embodiment, or with the technology as described in the second embodiment and the technology as described in the third embodiment. Of course, the washing machine may be implemented with the technologies described in the first to third embodiments.

The invention claimed is:

1. A washing machine comprising:

a spin tub receiving laundry;

a vibration sensor attached to a water tub that supports the spin tub inside the water tub and capable of detecting vibrations in a plurality of directions; and a processor configured to:

control rotation of the spin tub, determine a vibration type based on a detection value of the vibration sensor to determine whether there is waterproof clothing in the laundry, perform two acceleration processes to accelerate rotation of the spin tub in a low-speed rotation region upon starting a spin-dry process, compare detection values of the plurality of directions detected by the vibration sensor within a similar preset rpm zone in the two acceleration processes, and determine whether the laundry includes the waterproof clothing based on the comparison, and quantify magnitude relationships of the detection values of the plurality of directions detected in the respective acceleration processes to determine two magnitude relationship values for each of the acceleration processes, compare an amount of variation in the magnitude relationship values with a preset reference value, and determine whether the laundry includes the waterproof clothing based on the comparison.

2. The washing machine of claim 1, wherein to determine whether the laundry includes the waterproof clothing, the processor is configured to:

compare vibration types in the two acceleration processes, and determine whether the laundry includes the waterproof clothing based on the comparison.

3. The washing machine of claim 2, wherein the processor is configured to:

determine whether the laundry includes the waterproof clothing based on a change in at least one of a vibration state or an imbalance position in the two acceleration processes.

4. The washing machine of claim 1, wherein the detection values of the plurality of directions are detection values in a horizontal direction and a vertical direction.

5. The washing machine of claim 1, wherein the processor is configured to convert the detection values of the plurality of directions to comparable values by performing absolutization and smoothing on each of the detection values of the plurality of directions.

6. The washing machine of claim 5, wherein the processor is configured to:

subtract each of the detection values of the plurality of directions that is subject to the absolutization and smoothing in each of the two acceleration processes, and quantify magnitude relationships of output signals between respective directions in each acceleration process to determine the two magnitude relationship values.

7. The washing machine of claim 1, wherein the processor is configured to set a spin-dry rpm based on whether the laundry includes the waterproof clothing.

8. The washing machine of claim 1, wherein to determine whether the laundry includes the waterproof clothing the processor is configured to:

determine, from a signal output from the vibration sensor, an indication of abnormal vibration, when a rhythm component having a longer period than a rotation period of the spin tub is detected or when a variance rate of vibration amplitude of the water tub is greater than a preset reference value.

9. The washing machine of claim 1, further comprising:

a lid configured to open and close an inlet through which the laundry is taken in or out;

an open/close sensor configured to detect whether the lid is in an open state or a closed state; and a resume switch configured to resume an interrupted process when manipulated, wherein the processor is configured to reset a highest rpm of a spin tub in the spin-dry process to an initial state when the resume switch is manipulated after the lid is opened and closed.

10. The washing machine of claim 1, wherein in response to determining that the laundry includes the waterproof clothing, the processor is configured to:

reduce a highest rpm of the spin tub to a preset rpm or less in a spin-dry process performed after the determination;

sound an alarm through a notification buzzer;

display an error message on a display panel;

send notification of an error message to a terminal device; or stop operation.

* * * * *